United States Patent [19]

Dahl

[11] Patent Number: 4,756,448

[45] Date of Patent: Jul. 12, 1988

[54] VENDING MACHINE FOR VENDING ONE-AT-A-TIME MERCHANDISE ARTICLES OF A PLURALITY OF SIMILAR SUCH MERCHANDISE OBJECTS, EACH OF A SUBSTANTIALLY RECTANGULAR PARALLELOPIPED SHAPE, SUCH AS A NEWSPAPER, MAGAZINE, OR THE LIKE

[76] Inventor: Frank L. Dahl, 5248 W. 119th Pl., Inglewood, Calif. 90304

[21] Appl. No.: 906,134

[22] Filed: Sep. 11, 1986

[51] Int. Cl.[4] ..... G07F 11/14

[52] U.S. Cl. ..... 221/4; 221/155; 221/229; 221/241

[58] Field of Search ..... 221/65, 155, 228, 229, 221/241, 249, 279, 4

[56] References Cited

U.S. PATENT DOCUMENTS

| | | | |
|---|---|---|---|
| 3,705,665 | 12/1972 | Gunzler | 221/279 X |
| 3,749,281 | 7/1973 | Stovers et al. | 221/279 X |
| 4,530,444 | 7/1985 | Christian | 221/241 X |

*Primary Examiner*—F. J. Bartuska

[57] ABSTRACT

A novel vending machine for sequentially and selectively dispensing and vending in a merchandise dispensing region each one of a plurality of substantially similarly-shaped flat merchandise objects (usually each of substantially parallelopiped shape, such as that of a newspaper, magazine, or the like, although not specifically so limited) in an object-size-adjustable manner making it possible to quickly and easily initially adjust the apparatus to correspond to a particular thickness of depth-direction dimension of each of the merchandise objects which are to be dispensed so the dispensing apparatus is set exactly for that particular thickness of each of the similar merchandise objects; and conversely, being just as easily being differently adjusted for the appropriate sequential dispensing of each one of a plurality of different merchandise objects having completely different thicknesses in each case than in the first-mentioned case; and capable of easy adjustment into any intermediate adjusted relationship suitable for handling and easy dispensing of each one of a plurality of merchandise objects having a different thickness lying between the two extremes already mentioned.

13 Claims, 3 Drawing Sheets

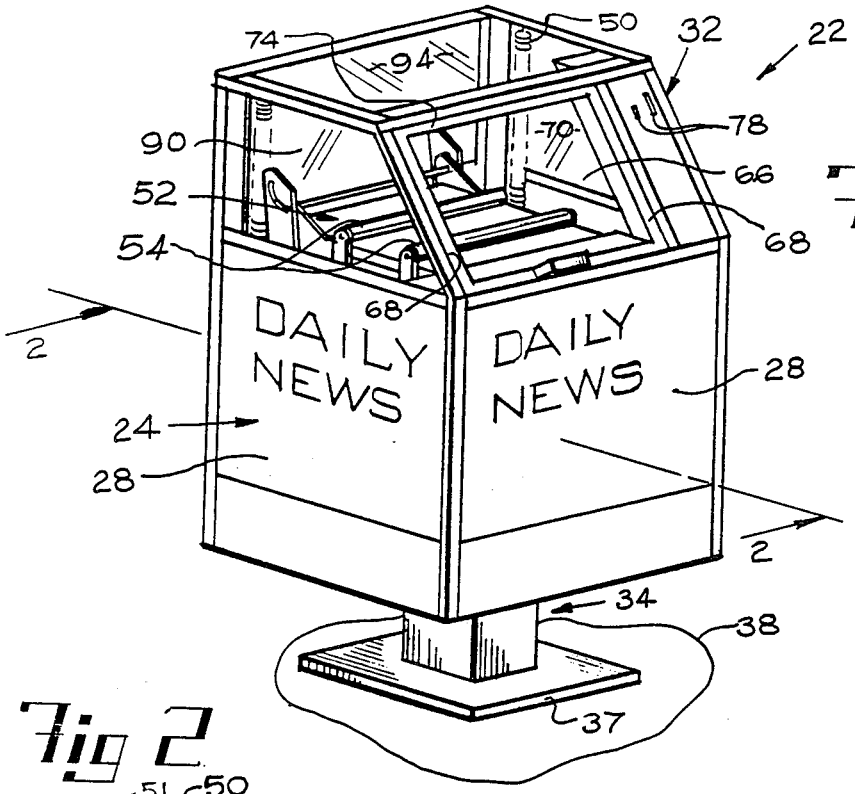
Fig 1
Fig 2
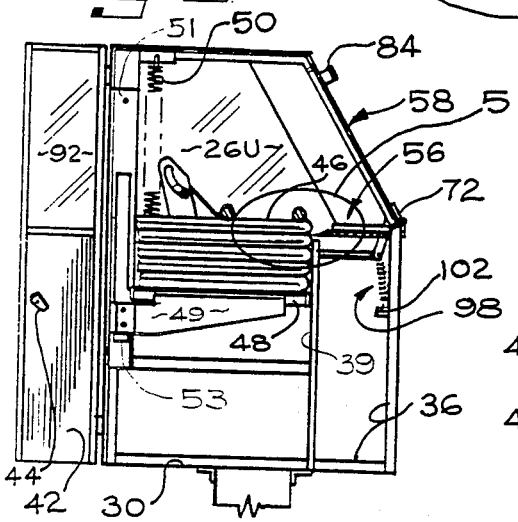
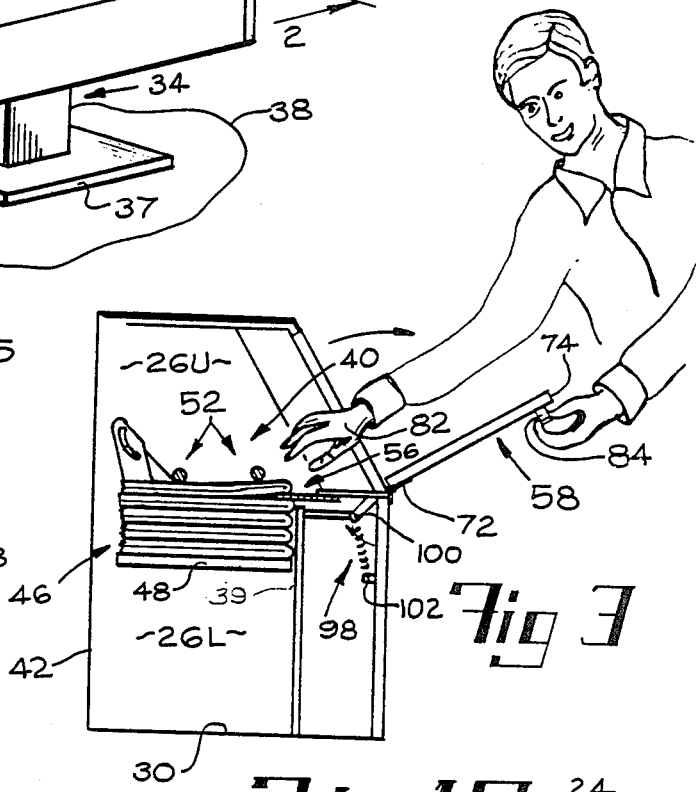
Fig 3
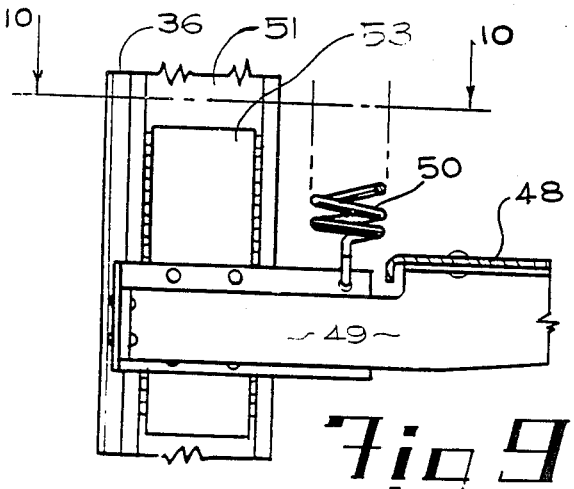
Fig 9
Fig 10
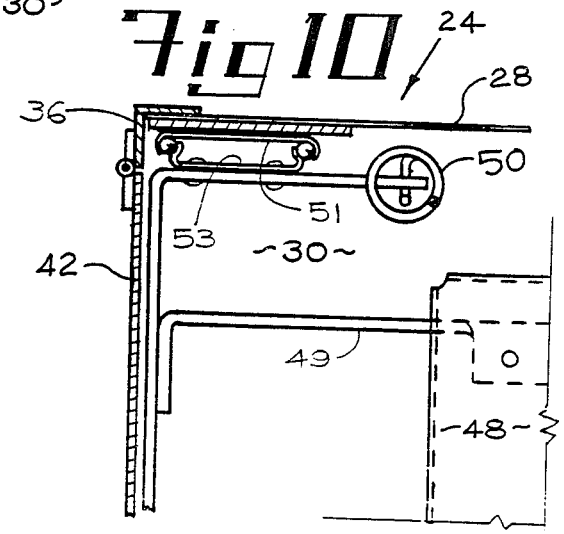

VENDING MACHINE FOR VENDING ONE-AT-A-TIME MERCHANDISE ARTICLES OF A PLURALITY OF SIMILAR SUCH MERCHANDISE OBJECTS, EACH OF A SUBSTANTIALLY RECTANGULAR PARALLELOPIPED SHAPE, SUCH AS A NEWSPAPER, MAGAZINE, OR THE LIKE

This present application (specification, claims and drawings) is tied to and correlated with an earlier "Disclosure Document" entitled, "A Vendor", and assigned number 140,046 on Aug. 2, 1985.

BACKGROUND OF THE INVENTION

The field of the invention is generally that of dispensing and vending apparatuses intended primarily for dispensing newspapers, magazines and other similar publications or the like, each of which is generally identified in length, width and depth to all of the other similar merchandise objects in that particular plurality of such merchandise objects which are to be dispensed. In other words, normally, the kind of merchandise articles referred to hereinbefore may vary in thickness and even in length and width in certain cases, but that is normally true only of one representative size which is the same for all of the individual ones of the merchandise objects making up the similar plurality thereof to be dispensed.

The prior arr methods and apparatus for dispensing or vending each of a plurality of the type of merchandise objects referred to above (usually newspapers, magazines, or the like, although not specifically so limited in all forms of the invention) have encountered difficulty arising from several changing situations which have frequently led to improper functioning, malfunctioning, or virtually total inoperativeness of such prior art vending apparatuses under certain conditions of operation. Consider, for example, one representative such prior art newspaper vending machine where it will be found that if the thickness dimension of each of a plurality of similar newspapers to be dispensed varies substantially from one vending machine loading operation to the next vending machine loading operation, it may be found that the vendor does not function correctly because of the changed thickness of each merchandise article (newspaper) which is to be dispensed. The changed thickness dimension may cause the machine to not dispense properly at all, or may cause it to jam, and in either case, the end result is a totally unsatisfactory performance by such a prior art newspaper vending machine.

Another problem encountered frequently in the operation of such prior art newspaper vending machines is the fact that it may provide easy access to more than one newspaper, so that more than one newspaper (or other merchandise article) can be manually removed from the vending machine each time it is operated (usually as the result of having received a predetermined proper pre-payment in the form of coins inserted into an associated coin-receiving and locking mechanism) when actually, the intent of such prior art vending machines is to dispense only one newspaper per vending operation.

It is believed to be quite apparent that any improvement in the construction of such a vending machine which would provide for a great range of thickness variation in each similar merchandise object of any particular assembly or group of a plurality of such merchandise objects, so that the dispensing operation would be optimally performed for the particular thickness of that merchandise object and any tendency to jam, or to not feed or to otherwise malfunction will be completely overcome, while at the same time, not facilitating the undesired dispensing of more than one merchandise article at a time, would be a highly desirable improvement because such an arrangement would virtually completely overcome the above-mentioned prior art problems and disadvantages. Furthermore, it is believed to be apparent that such an improved construction would result in the advantages indicated which essentially flow from and occur by reason of the specific features of the present invention pointed out hereinafter.

SUMMARY

Generally speaking, the present invention comprises a novel vending machine for sequentially and selectively dispensing and vending each one of a plurality of generally similar and substantially similarly-shaped flat merchandise objects (each of a parallelopiped shape in one preferred form, although not specifically so limited in all forms of the invention) in merchandise-object-size-adjustable manner. In one preferred form, the invention includes a hollow housing defining therein an enclosure having a predetermined length dimension, a predetermined transversely perpendicular width dimension and a predetermined depth dimension perpendicular to both said length dimension and said width dimension whereby to cause the enclosure to include a merchandise-storage portion having therein a merchandise-dispensing region of substantially parallelopiped shape and of a selected length, width, and depth such as to be large enough for interior storage of a plurality of depth-direction stacked merchandise objects, each of a similar substantially flat configuration, each of a predetermined length and width substantially less than the corresponding length and width dimension of said hollow enclosure.

Furthermore, in one preferred form, the merchandise-storage portions thickness dimension for each of the merchandise objects adapted to be stacked and stored therein is only a small fraction of the total depth dimension thereof, whereby to provide for the depth-direction stacked superimposition of a plurality of such similar merchandise objects within said enclosure.

In one preferred form, the apparatus also includes a transverse, substantially flat supporting platform or table cooperable to receive said plurality of similar depth-direction stacked transversely oriented merchandise objects thereon within said hollow enclosure; and is further provided with an opposite-to-depth-direction biasing spring means cooperable with said transverse supporting platform or table and also cooperable with a fixed connection point of the apparatus for normally forcing said stacked plurality of similar merchandise objects in the biased opposite-to-depth direction substantially perpendicular to the transverse orientation of each of the merchandise objects.

Also, in one preferred form of the object, controllably adjustable stop means is positioned in a manner spaced from the supporting platform or table so as to define an adjustable spaced relationship therebetween in an opposite-to-said depth direction manner such as to allow a desired number of stacked merchandise objects to be positioned between said supporting platform or table and said spaced stop means.

Also, one preferred form of the invention includes separator means positioned within the hollow enclosure and transversely adjacent to merchandise dispensing region defined between the supporting platform or table and the spaced stop means whereby to be immediately transversely adjacent to such a stacked assembly of such merchandise objects, with said separator means being displaced in said depth direction by a short distance corresponding to the depth and thickness dimension of one of such merchandise objects and comprising a factor of the complete depth dimension of said merchandise dispensing region corresponding to the number of such merchandise objects to be stacked therein and individually and sequentially dispensed therefrom; with said separator means being controllably manually extensible from a normal at-rest position into a manually caused activation position with said separator means being then forced between an end one only of such a plurality of stacked merchandise objects and the remainder thereof whereby to cause the end one only of said merchandise objects to be effectively segregated from the remainder of stacked merchandise objects so that the end one of said merchandise objects is in a condition to be manually removed from within the hollow enclosure.

Also, in one preferred form of the invention, the housing means is provided with a manually openable access door which is further provided with coin-openable locking means normally locking the access door in closed relationship with respect to the housing means, and additionally provided with exteriorly accessible coin-receiving means carried by the housing means and coupled to the coin-openable locking means and cooperable therewith to unlock the access door upon receipt of a proper coin (which shall also include the meaning of a proper total value for several received coins), which will cause the separator means to segregate the end one of such a plurality of stacked merchandise objects from the remainder thereof while the access door is being opened, thus placing the end one of the merchandise objects in a position readily accessible to the hand of a person inserted through the temporarily opened access door to allow the manual removal in a transverse direction, of the end segregated one only of such a plurality of stacked merchandise objects lying within the merchandise-dispensing region.

In one preferred form, the stop means adapted to be positioned at one end of the merchandise-dispensing region, takes the form of roller means adapted to press against the end surface of an end one of such a stacked plurality of merchandise objects when in machine-loaded position within the merchandise-dispensing region ready for a subsequent single-merchandise-article-dispensing operation, whereby to facilitate the free, rolling, transverse, lateral dispensing movement and removal of an end one only of such a stacked plurality of merchandise objects.

In one preferred form, the housing means includes a transparent viewing portion (usually, in a top part of the housing means) encompassing and defining a viewing region positioned adjacent to an end one of such a stacked plurality of merchandise articles (or objects) for exterior viewing thereof by a prospective purchaser thereof.

While the invention, broadly speaking, includes a number of possible different orientations within the hollow enclosure for the merchandise-dispensing region and, thus, for the effective stacked depth-direction orientation of the plurality of similar merchandise objects lying therein, one particular specific preferred form thereof contemplates depth-direction as being vertically directed which means that the flat supporting platform or table lies in substantially horizontal plane and the stop means also lies in an upwardly spaced horizontal plane or position above the lower-positioned supporting platform or table whereby to cause the depth-direction stacked, transversely oriented merchandise objects therebetween to effectively comprise vertically stacked horizontally oriented merchandise objects having said end merchandise object which is to be dispensed comprising an uppermost horizontally positioned one of said merchandise objects which is to be effectively segregated from the remainder thereof by horizontal operation of the separator means, which will result in maintaining said remainder of said vertically stacked merchandise objects below said separator means, leaving only the dispensible end of an uppermost one of said horizontal merchandise objects in a position such as to be manually substantially horizontally removable from within the hollow enclosure when the coin-operated access door has been manually and temporarily opened.

OBJECT OF THE INVENTION

With the above points in mind, it is an object of the present invention to provide a novel vending machine for individually dispensing and vending one each of a plurality of substantially similarly shaped generally flat merchandise objects or articles (and often comprising a multi-page publication or the like, although not so specifically limited in all forms of the invention.)

It is a further object of the invention to provide a novel vending machine of the character referred to herein, which is capable of optimally dispensing one each of a plurality of similar merchandise objects where each merchandise object has been changed in size from previous merchandise dispensing sequence handling similar merchandise objects each of which is radically different from each merchandise object in the other set thereof to be dispensed. In other words, a size-adjustability feature is present in the novel vending machine making it suitable for dispensing all relatively thin merchandise objects, or all relatively thick merchandise objects, or a plurality of similar merchandise objects, each having an intermediate thickness lying between the thin and thick extremes just mentioned. This size adjustability feature can also handle a certain range of size variations in the length direction, the width direction, or both of same, insofar as applied to each merchandise article or objects in a particular plurality thereof which is to be subsequently dispensed individually.

It is a further object of the invention to provide a novel vending machine of the type referred to herein, wherein the depth-direction dimensions of the various operating portions of the dispensing apparatus are vertical directions, thus, causing all of the transverse dimensions and directions and planes to be substantially horizontal, so the biased feeding of the vertically stacked plurality of similar merchandise articles is upward feeding thereof so that after each dispensing operation, the next uppermost one of the merchandise objects is moved upwardly into the top or uppermost dispensing position for subsequent horizontal dispensing thereof after the next receipt of the proper coin (or coins) by the coin-receiving means and the corresponding manual opening of the access door for removal of the uppermost one only of said merchandise objects.

It is a further object to provide a novel vending machine of the character referred to herein, generically and/or specifically, and which may include any or all of the features referred to herein, either individually or in combination, and which requires only relatively simple manufacturing processes (including relatively low tolerances, etc., and relatively low cost tooling and production machinery to produce same, which thereby greatly reduces the cost of each item produced and further requires a minimum of capital and/or tooling costs and/or costs involved for setting up improved items of the present invention for a production run. All of these features can be applied to the production of virtually any type, size or shape of vending machine, for vending a great variety of different types of articles or objects, and with the potential variety of such different manufacturing forms tending to bring about reduced cost, which is conducive to widespread production, distribution, sale and use of the novel improved vending machine of the present invention for the purposes outlined herein, or for any other substantially functionally equivalent purposes.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to taken as representative of the multiple embodiments of the invention which lie within the scope of the invention.

BRIEF DESCRIPTION OF THE DRAWING FIGURES

FIG. 1 is a greatly reduced-size three-dimensional perspective view showing one exemplary embodiment of one representative form of the invention wherein it is mounted in one non-limiting manner in an upstanding convenient access location and is arranged to dispense one copy at a time of a merchandise article comprising a publication taking the form of a newspaper (although not specifically so limited) whenever it is operated by inserting the proper operation charge in the form of one or more coins. As illustrated in FIG. 1, the coin receiver portion of coin-operated locking means is shown on the front of the apparatus in a pre-operated condition and an access door to the interior merchandise-dispensing region is shown in a pre-opened normally closed and locked relationship, but with transparent viewing window means allowing a prospective customer to view the stacked newspapers within. The coin mechanism may be of manually movable two-position type or of an internally operated type, as shown.

FIG. 2 is a fragmentary, partially broken-away view taken substantially along the plane, and in the direction indicated by the arrows 2—2 of FIG. 1, with certain lower portions of the apparatus broken away for drawing simplification reasons. In this view, the coin-receiving means of FIG. 1 is shown in normal pre-operative condition similar to the showing of FIG. 1 and correspondingly, the access door means is shown in normally closed and locked relationshipl similar to the showing of FIG. 1. In other words, all portions of the apparatus are in a normal pre-operated condition as shown in both FIG. 1 & FIG. 2.

FIG. 3 is a fragmentary, partially broken-away, partially vertical sectional plane view similar to FIG. 2, but in FIG. 3, the various moving portions of the apparatus are shown in a subsequent post-operated condition after one or more coins (equivalent to the appropriate amount required for one newspaper) has or have been received by the coin receiving mechanism and have released the interior coin locking mechanism, thereby unlocking the access door which has been manually swung from the normally closed relationship thereof in FIG. 2 into the open relationship thereof shown in FIG. 3 which has also caused leftward horizontal extension operation of the separator means to separate the uppermost one of the vertically stacked newspapers from the remainder thereof to facilitate manual grasping of the newspaper's back/(or folded) edge and the manual horizontal forced removal of the thus-separated and segregated top newspaper only through the temporarily open access door, which is subsequently closed, thus, returning the apparatus to the normal closed locked relationship shown in FIG. 2.

FIG. 4 is a three-dimensional view, partially in oblique elevation, and comprising a central view of the carriage portion of the apparatus at the central portion of FIG. 2, but with the stacked plurality of merchandise objects (such as the newspapers shown in FIGS. 2 & 3) removed from FIG. 4 in order to more clearly illustrate one exemplary representative form, which the portions of the apparatus engaging the uppermost surface of the uppermost one of such a plurality of newspapers and at the bottom engaging the lowermost surface of the lowermost one of the plurality of newspapers may take for size-adjustment purposes to allow the apparatus to be effectively adjusted to allow very substantial adjustment to handle each of a plurality of thick newspapers, or each of a plurality of thin newspapers or each of a plurality of any publication item of a selected intermediate thickness. This actually functions by effectively allowing both of the rollers of the uppermost stop means to be adjusted to a desired initial vertical spacing above the plane of the transversely horizontally extendable separator means so that when the separator means is extended leftwardly as shown in FIG. 3, it will be extended exactly into a space between the bottom surface of the uppermost one of the stacked newspapers and the uppermost surface of the second one of the stacked newspapers as is clearly shown in FIG. 3. At the same time that the rollers/(or other pressure plate means) of the stop means are adjusted upwardly for increased initial vertical spacing, they are also moved somewhat to the left to properly compensate for the effective enlargement at the folded edge of the newspaper provided by the enlarged edge radius thereof.

FIG. 5 is a very fragmentary largely diagrammatic view of just that portion of FIG. 2 lying within the circle designated by the numeral 5 and more clearly illustrates a first condition as referred to above wherein each of the stacked newspapers is relatively thin. FIG. 5A is like FIG. 5, without proper top spacing pressure.

FIG. 6 is a fragmentary largely diagrammatic view quite similar to FIG. 5, but illustrates an alternate arrangement where each stacked newspaper is very much thicker than in the arrangement shown in FIG. 5 and the upper roller spacing has been vertically increased to compensate for same, while at the same time, it has also been moved slightly to the left to get around and effectively bypass the radial enlargement of the thickened folded edge of the newspaper.

FIG. 7 is another enlarged fragmentary largely diagrammatic view similar to FIG. 5 and to FIG. 6 and in particular, it shows what would happen if the roller means were upwardly spaced to handle the thicker newspaper shown in FIG. 7 without at the same time, causing the roller means to be slightly leftwardly displaced in the manner of FIG. 6 and thus being positioned at a level still below the highest level of the top newspaper lyipg to the left of said displaced roller means. This would tend to effectively hold back the uppermost newspaper from being effectively dispensed toward the right in the intended manner and could cause a malfunction which the altered structure operating as shown in FIG. 6 completely eliminates.

DESCRIPTION OF THE PREFERRED EMBODIMENT

Figure 4:
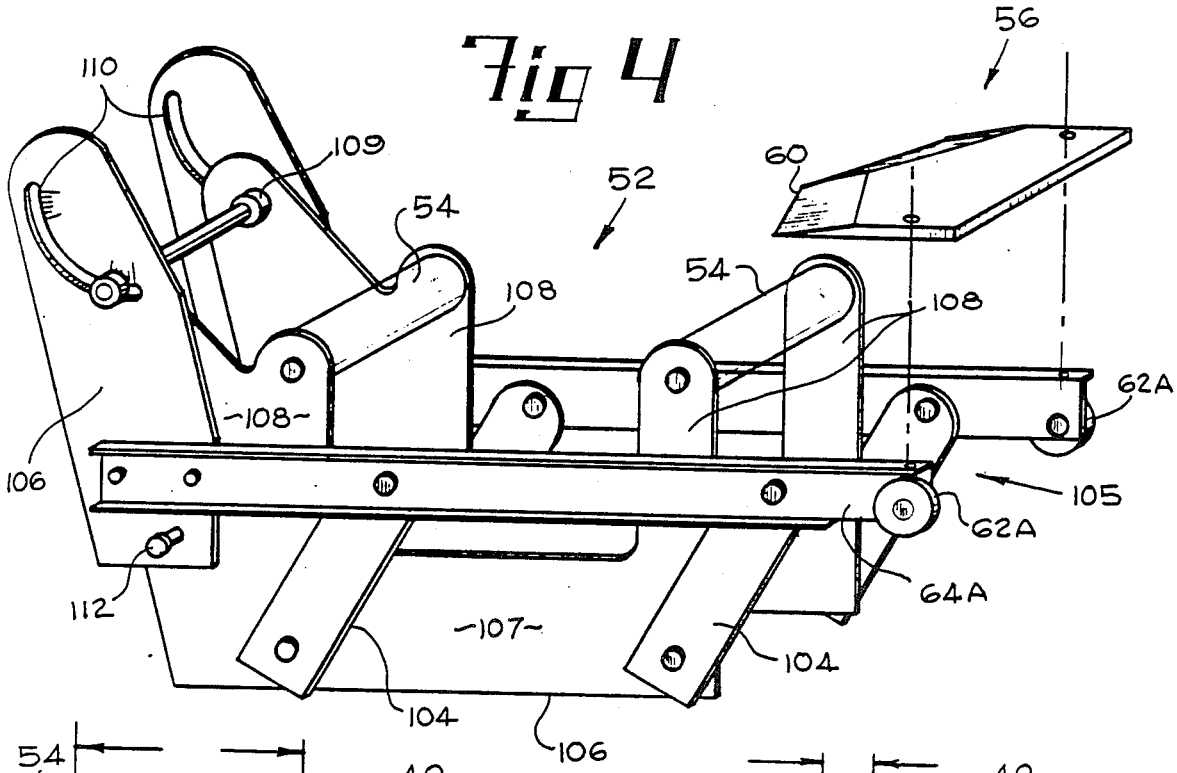

Generally speaking, the novel vending machine of the present invention comprises a specific and particular vending apparatus for sequentially and selectively dispensing and vending each one of a plurality of substantially similarly shaped, flat, merchandise objects (each usually of substantially parallelopiped shape, although not specifically so limited in all forms of the invention) in an object-size-adjustable manner making it possible to sequentially dispense a plurality of similar merchandise objects where each is relatively thin in a depth direction or to selectively sequentially dispense each one of a different plurality of similar, but very much thicker merchandise objects than in the first case mentioned, with this size adjustment feature being operable over a relatively wide range of adjustment sizes from very thin to very thick (all in what might be termed a depth direction) and with other dimensions of each similar merchandise object (that is, length and width dimensions thereof) being similarly capable of substantial size adjustment insofar as the vending apparatus is concerned, so it will be capable of dispensing large area newspapers and the like, small area newspapers and the like, and virtually any newspaper page surface area size in between large and small sizes of a predetermined size adjustable range.

As illustrated, the entire vending machine or apparatus is indicated generally by the reference numberal 22 and comprises a hollow housing such as is indicated at 24 and which defines therein a hollow interior or enclosure indicated generally at 26 and including an upper portion 26U and a lower portion 26L. The housing 24 may comprise a plurality of upstanding walls which may be made of thin sheet metal, plastic, or the like as indicated at 28 and which are four in number in the example illustrated with each being an upstanding wall mutually perpendicular with respect to the next adjacent upstanding wall 28 so as to define the lower enclosure portion 26L as being of substantially rectangular shape, in the particular example illustrated, although the invention is not specifically so limited in all forms of the invention.

In the specific exemplary form illustrated the lower portion 26L of the enclosure may be provided with a bottom wall 30 closing off the bottom of the lower enclosure portion 26L to prevent unauthorized access into the interior of the apparatus except under specified conditions when an authorized person wishes to gain access to the interior of the apparatus for insertion or removal of merchandise objects and/or for the removal of coins which have been fed into the coin-receiving means, one exemplary form of which is indicated generally at 32, for the purpose of selectively dispensing a single uppermost one of a vertically stacked plurality of merchandise objects positioned within the enclosure 26. It should be closely noted that that the coin-receiving means or coin-control means for controlling a dispensing operation may be of any of several different types some of which have a manually operable exterior portion or member which is normally adapted to be manually moved from a pre-operated condition into an interior operated position after a coin (or a proper plurality of coins) has or have been placed therein. On the other hand, an interiorly operated form of coin-receiving means and coin-control means not requiring such exterior manual operating movement by a would-be purchaser of one of the merchandise objects (newspaper, in the example illustrated) may also be employed and such is illustrated in the exemplary first form of the invention, although the invention should be clearly understood to be cooperable with, and to be capable of being controlled by any conventional type of coin operated or coin controlling mechanism not to be specifically limited to the exemplary one shown.

In the particular example illustrated, a mounting pedastal, indicated generally at 34, is connected to some strong attached part of the complete dispenser or vendor 22 so as to provide a strong base support for the entire vending apparatus 22, and with the lower end of the pedastal 34 being provided rigidly with a large-area foot-plate 37 adapted to rest upon a horizontal ground surface, such as is indicated diagrammatically and fragmentarily at 38, whereby to provide positive support for the entire apparatus at any selected location, where it may be provided with fastening chain means or any of various different types of locking means for locking it to some fixed object so it cannot be stolen by physically removing the entire vendor 22 from its public position or vending location. Such fastening, anchoring and/or locking means are well-known in the art, and, therefore, will not be described in detail herein, or shown in great detail in the drawings, inasmuch as the present inventive concept does not lie in that aspect or feature which, primarily contributes mainly to the practicality of the entire device.

In the specific example illustrated, the hollow housing 24 is effectively provided with what might be termed structural frame portion 36 and the previously-mentioned connection of the pedastal 34 to the entire vendor 22 may be such as to effectively include a connection to said framework means, thus, providing a very strong overall structure.

A merchandise door or access door may be provided in, or on any of the four side walls 28 of the housing 24 or, alternatively, bottom access means or top access means may be provided and relied upon for entry of the hand or arm of an operator-proprietor of the vending machine into the interior enclosure 26 thereof for the purpose of initially placing a number of merchandise objects therein in a merchandise dispensing region such as is generally indicated at 40, and all such arrangements are intended to lie within the broad scope of the present invention and to be included and comprehended herein.

However, for the purposes of simplicity and clarity, the first form of the present invention illustrated is provided with one particular type of merchandise door of the several different types which lie within the broad scope of the present invention and the exemplary one shown for illustrative purposes only is indicated generally at 42 and comprise a back door extending across all of a substantial portion of the rear or back upstanding wall (or wall portions) 28 forming that part of the housing 24. This may be across a large area of the back, or a lesser area of the back, but, in particular, across the lower portion of the back of the housing 24 in communication with the lower enclosure portion 26L. The merchandise door 42 is provided with lock means 44 which can be a combination type lock, a key operated lock, a magnetic coded data card-controlled lock, or any other type of lock which can be selectively locked and/or unlocked lay an authorized operator of the vending machine 22 to allow him to place a stack of newspapers within the interior enclosure 26 (and with the bottom part of the stack of newspapers extending downwardly into the lower enclosure portion 26L) in a vertically stacked array thereof, and with the bottom newspaper 46 resting on a table or support 48 which is normally upwardly biased by biasing spring means 50 (shown as being at a selected off-center location, because of the mechanical configurations of the cooperating structures) so that the entire stack of newspapers 46 will be biased upwardly against a positionally adjustable, locationally adjustable, stop means, such as is indicated at 52 and which includes multiple roller means (or other pressure plate means) which is positioned in an adjustably spaced relationship relative to the table or support 48 so as to allow a desired number of the stacked merchandise objects (newspapers 46 in the example illustrated) to be positioned between the supporting platform or table 48 and the rollers 54 of the stop means 52—all in a manner such as to positively hold the vertically stacked assembly of newspapers 46 in the dispensing region 40 with the uppermost one of the stacked newspapers 46 positioned just above what might be termed a separating plane coincident with the position of the horizontally directed and horizontally receiprocatingly movable separator blade means, indicated generally at 56, when it is caused to be operated by the manual opening of a top front vending access door generally indicated at 58 in the manner best shown in FIG. 3.

In other words, the separator means 56 includes a knife-edged separator blade 60 which is effectively slideably mounted by roller means 62 and 62A, each of which cooperates with a corresponding different one of two track means 64 and 64A, with all four of same being so coupled as to provide fore and aft longitudinal movement of the knife-edged separator blade 60 whenever the vending access door 58 is closed or open respectively. In other words, when the vending access door 58 is opened from a normally closed position as shown in FIG. 2 into a fully opened position as shown in FIG. 3, an operating portion or lever portion 65 (best shown in FIG. 11) and which is normally removably coupled by way of a selectively engageable and disengageable pin 112 with respect to said operating portion 65 attached to an offset bottom crank or lever portion of the frame of the front access door 58 and with the pin 1 being effectively removably engaged by the structure just defined and being adapted to be longitudinally rearwardly moved (or leftwardly moved) as shown in FIGS. 1, 2, & 3, whenever the access door 58 is opened which thus causes the two track members 64 & 64A to be correspondingly leftwardly moved so as to force the knife-edged separator blade 60 exactly between the bottom surface of the uppermost one of the stacked newspapers 46 and the top surface of the second newspaper 46 in the stack thereof.

Figure 1:
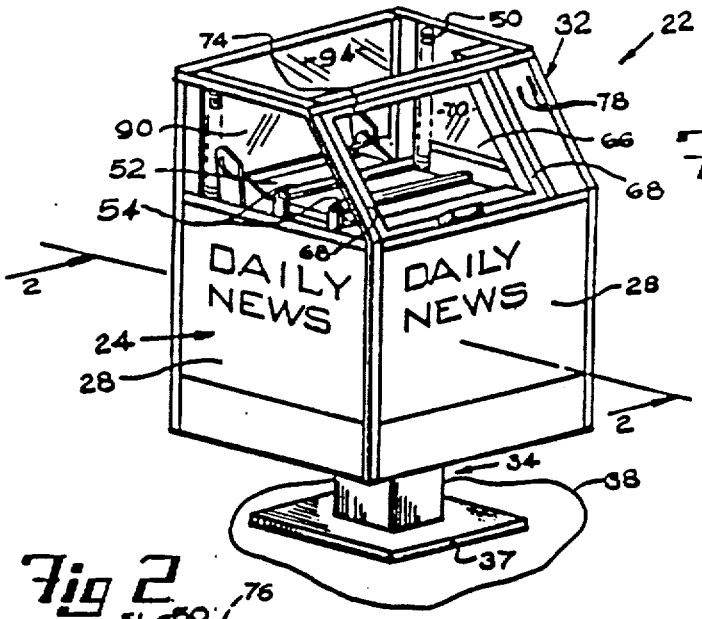
Figure 2:
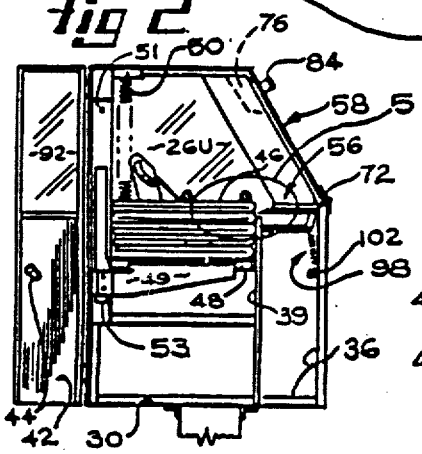
Figure 3:
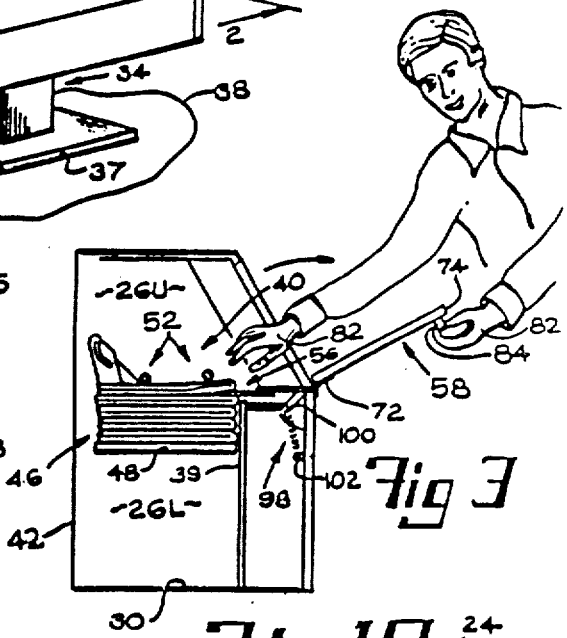

It should be noted that the separator means 56 can be said to be slideably mounted for the fore and aft kinds of movement between the forward extreme position shown in FIG. 2, and the rearward extreme position shown in FIG. 3 in response to corresponding manual movement of the front access door 58 between the normally closed and locked relationship shown in FIGS. 1 & 2, and the temporarily unlocked and open position shown in FIG. 3. In the example illustrated, this is accomplished by the composite roller means and track means structures 62, 62A, 64 & 64A, but these are merely illustrative, and are not to be construed as specifically limiting the invention to that particular arrangement.

In the particular exemplary form illustrated, the manually openable front and top access vending door 58 is of a particular construction wherein it comprises the angularly inclined, front-positioned viewing window 66 which is usually provided with window frame edge means of structurally strong material as indicated at 68 and mounting across the central portion thereof a transparent pane or panel 70 usually made of a relatively difficult-to-break transparent material such as reinforced or specially treated and specially toughened glass (commonly known as bulletproof glass, or the like) or of polycarbonate plastic resin sheeting of a type known by the manufacturers thereof, The General Electric Company, as "LEXAN", virtually unbreakable window material, or any other substantial equivalent thereof. In the example illustrated, the door is hinged along the bottom front edge thereof by hinge means indicated at 72 and has a swingable opposite opening edge 74 which is normally adapted to be locked by locking means indicated generally at 76 until such time as the exteriorly accessible coin-receiving means 32 carried by the housing is provided with one or more proper coins in the receiver opening 78 which will initiate unlocking operation of the locking means 76, thus allowing the coin to properly operate interiorly positioned coin-openable locking means comprising the means shown diagrammatically at 76 so as to temporarily unlock and release the vending access door 58 so it can be temporarily manually opened by having an operator's hand 82 grasp an operating handle 84 near the top edge of the door 58 and swing it outwardly and downwardly around the horizontal axis of the hinge means 72 from the normally closed position shown in FIG. 2 into the temporarily open position shown in FIG. 3. The interior portion of the coin-receiving means 32 may be coupled to the upper-positioned locking means 76 by linkage means (interior or exterior). This may be mechanical linkage, electrical linkage or any other well-known type of linkage for causing the slave portion of the linked apparatus (as shown at 76) to be operated by and in exact correspondence to the operating instructions provided by the master, sender or transmitter portion of the apparatus (comprising the inner structure of the coin-openable locking means 32 in the example illustrated).

In the example illustrated, the rest of the upper part of the housing 28 (substantially all portions thereof lying above the horizontal plane containing the separator means 56) has top and side wall parts also of transparent window-like material, usually similar to that shown at 70 as comprising the main panel of the front viewing window 66 and the front vending access door 58 so that it is possible to look through any of the two side panels 90, the back panel 92 and the top panel 94 to see the stack of newspapers 46 positioned within the hollow enclosure 26 and ready for the next newspaper vending and dispensing operation of a single uppermost one of the stacked plurality of newspapers 46 when the proper coin (or plurality of coins totalling the proper sum) is sequentially fed into the coin-receiving means 32 (causing same to be operated) and the vending access door 58 is manually opened from the closed position of FIGS. 1 & 2 into the temporarily open vending and dispensing position shown in FIG. 3.

The merchandise object loading and unloading access door 42 is normally closed and locked so a would-be street purchaser of a newspaper will have no access through said merchandise door 42 (normally very securely locked) into the interior of the enclosure 26. The only access which can be provided during a vending operation is that previously described which occurs through the top vending access door 66 when it is temporarily opened by a would-be customer after he has paid the proper sum of money for the purchase of a single newspaper and has fed it into the machine through the coin-receiving means 32 in the manner indicated in FIG. 3.

The loading and unloading of the machine with a plurality of newspapers such as those shown at 46 is readily accomplished by an authorized person servicing the machine who normally is provided with key means or the like, to unlock the locking means indicated generally at 44 so that the rear panel surrounding the lower part 26L of the enclosure can be selectively opened. Then, the serviceman will normally forcibly depress the platform table or support downwardly against the action of biasing spring means 50 until there is sufficient room to place a fresh stack (a plurality) of newspapers which are intended to be subsequently sequentially dispensed on the platform support or table 48 with all of the folded edges 47 of the stacked plurality of newspapers 46 being similarly positioned toward the front of the vendor (toward the right of the vendor as shown in FIGS. 2 & 3) and then the stop means 52 (including the two rollers 54) is vertically adjusted (and in a preferred form, slightly rearwardly adjusted as will be explained hereinafter) so that the horizontal stop plane provided by the stop means 52 rollably pressing against the top surface of the uppermost one of the vertically stacked newspapers 46 will hold that newspaper at precisely the right horizontal level such that the bottom surface of that uppermost one of the stacked plurality of newspapers is exactly aligned with and very slightly spaced above the top surface of the knife-edged separator blade 60 of the separator means 56 so they will lie in the exact relationship most clearly shown in FIG. 2 and so that when said separator blade 60 is forcibly moved in said horizontal plane toward the rear of the machine in response to temporarily manual opening of the vending access door 66 in the manner shown in FIG. 3, said separator blade means 60 will slideably move directly between the uppermost one of the newspapers 46 and the next or second uppermost one of the newspapers 46 lying immediately therebelow in the manner clearly shown in FIG. 3—and does so with no tendency to engage or tear either newspaper but merely to smoothly slide therebetween thus, effectively isolating the uppermost newspaper 46 from all of the others in the vertically stacked assembly thereof and rendering said upper newspaper 46 (now segregated by the separator blade means 60 from the rest thereof) conveniently manually accessible for manual withdrawal from within the temporarily open machine through the temporarily open vending access door 58 by the hand 82 of a customer. This vending and dispensing operation is facilitated by the fact that the rollers 54 of the adjustable stop means 52 minimize friction during the manual withdrawal of a single uppermost newspaper 46 during such a dispensing operation.

The separator means 56 is freely mounted for the necessary horizontal travel by having a plurality of rollers 62 & 62A rollably mounted in a pair of front to rear guide tracks 64 & 64A which in the example illustrated, are structurally mounted with respect to side portions of the framework means 36, or to corresponding inside surfaces of the housing means 28 carried by said structural frame portion 36. The arrangement is such as to define the exact number of degrees of freedom needed for the horizontally positioned separator means 56 to provide for its top newspaper separating and isolating operation in the manner described hereinbefore and as is clearly shown in FIG. 3. The motive force for causing rearward newspaper separating operation of the separator means 56 from its normal pre-operated condition as shown in FIG. 2 into its fully operated position as shown in FIG. 3, is, in the representative form illustrated, shown is being provided by coupling means or an operating portion of a lever action type, indicated at 65 and which comprises an offset lever beyond the pivot point of the mechanism and/or the front vending access door 58 and slideably and pivotally linked to the separator blade means 60 so that opening of the door 58 forcibly rearwardly (leftwardly as viewed in FIGS. 2 & 3) extends the separator blade 60 between the two uppermost newspapers 46 in the manner shown in FIG. 3, while the opposite movement (closing movement) of the vending front access door 58 back toward the normally closed and locked position thereof as shown in FIG. 2, forcibly retracts, or moves (toward the front of the machine) said separator blade 60 until it has returned to its normal fully retracted relationship as shown in FIG. 2.

Normally, means is provided for returning the above-described separator means, coupling means and access door to initial unoperated relationship thereof such as is shown in FIG. 2. While this may take various forms, one such return biasing spring means is shown at 98 and takes the form of a tension spring connected at one end as indicated at 100 to an offset portion of said separator blade offset or operating lever portion 65 and connected at the other end to a fixed attachment location 102 of the framework means 36 or any substantially equivalent arrangement.

FIGS. 5, 5A, 6 & 7 illustrate two types of malfunctions which can happen with the separator blade means 60, during its rearward movement in response to the opening of the access door 58, if the roller 54 is not properly co-actively adjusted in a proper rearward displacement relationship with respect to the vertical stop bars 39 (stop bars for the front edges of the newspapers 46) and with respect to the vertical adjustment of the rollers 54 relative to the separator blade 60. In other words, the roller 54 must be adjustably moved rearwardly in a horizontal direction, as well as upwardly in a vertical direction to accomodate thickness differences of various different newspaper editions.

Figure 5A:
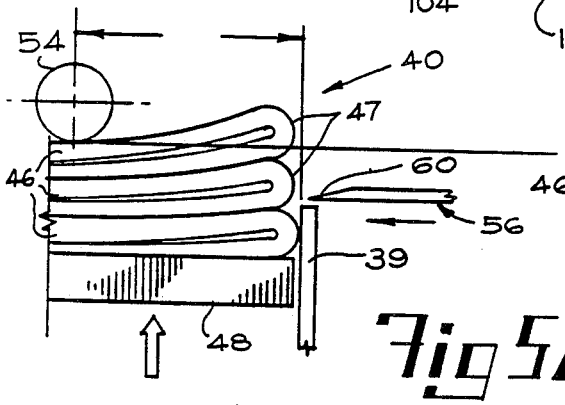
Figure 5:
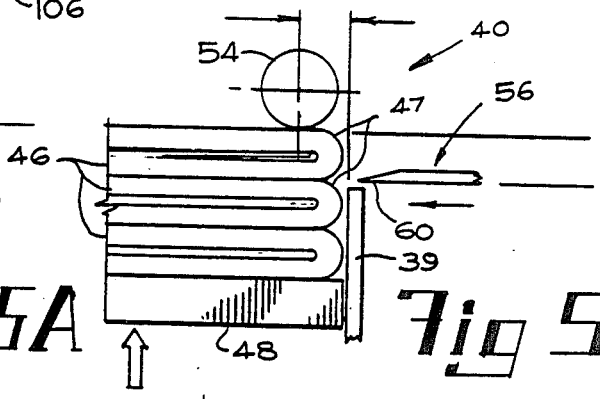

The first type of the above-referred-to malfunction that can occur if only a proper vertical adjustment of the roller 54 is made (without the proper rearward horizontal adjustment thereof also being made) is shown in FIGS. 5 & 5A. In FIG. 5, the roller 54 is correctly adjusted, both as to its vertical setting (as indicated at x 1) and as to its horizontal setting (as indicated at y 1) and one can observe that the blade separator 60, is in proper alignment with the plane of contiguity of the topmost and the second topmost newspapers of the stack of newspapers 46.

Figure 7:
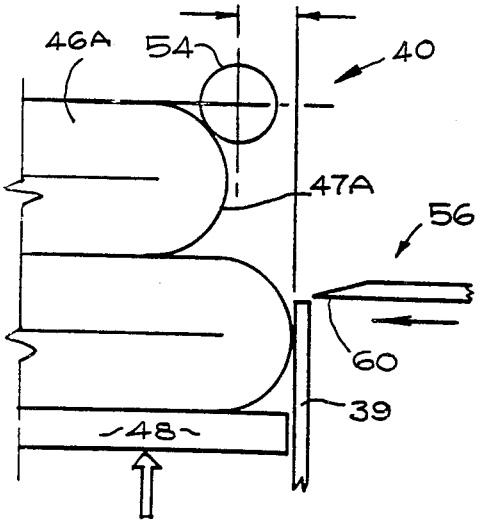
Figure 6:
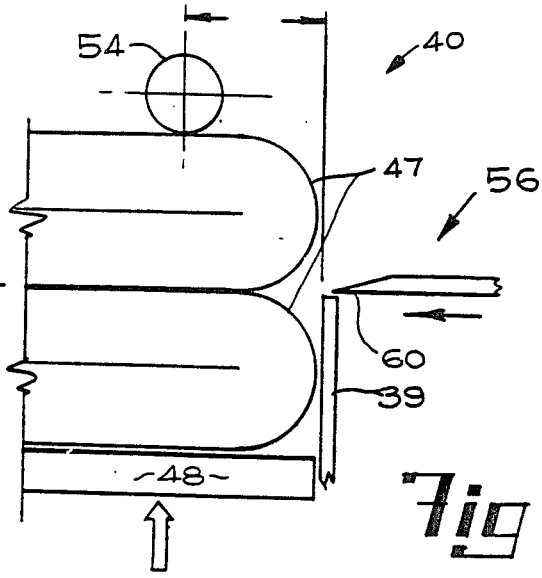
Figure 8:
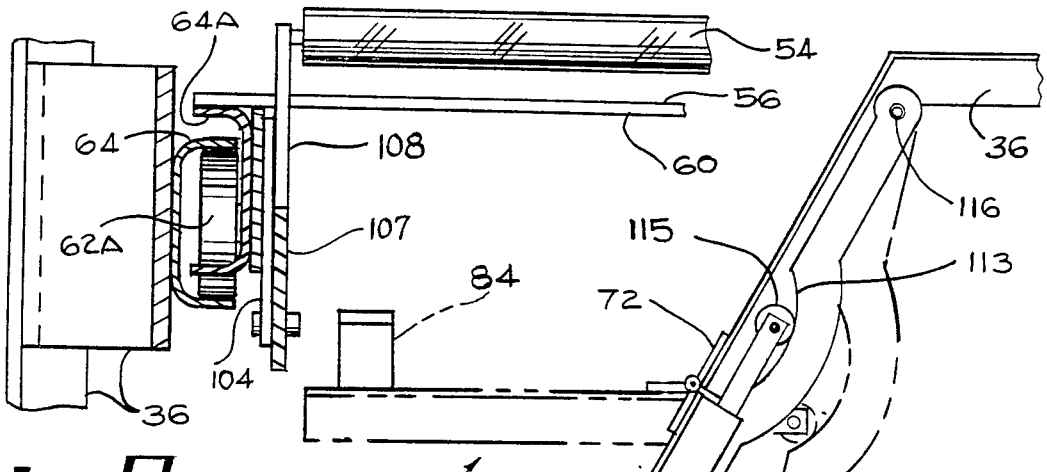
FIG. 8 is an enlarged fragmentary partially broken-away sectional view taken substantially along the plane and in the direction indicated by the arrows 8—8 of FIG. 4 and illustrate representative track and track follower means of one representative form of the invention.

FIG. 5A illustrates what would result if the rollers 54 were incorrectly adjusted rearwardly relative to another setting such as that indicated by the excessively-spaced setting y 1'. Because newspapers, when stacked, have a compressed thickness greater at the stacked plurality of folded edges than the stacked thickness of other areas of the multiple newspapers, a stack of such newspapers will have its folded edges effectively expanded upwardly when the whole stack is compressed by the action of the spring-biased platform 48 towards the roller 54 of the stop means 52. Therefore, the rollers 54 should be placed rearward of a vertical line which substantially passes through the radii (and the effective center thereof) of each of the newspapers' folded edges 47. This effective upward expansion or so-called "cushioning effect" will, as FIG. 5A illustrates (although somewhat exaggerated) cause displacement of the plane of contiguity referred to hereinbefore and common to the two upper or top newspapers 46, with reference to the separator blade 60. In fact, said so-called "plane of contiguity" will be so distorted as to have a somewhat curved configuration as is very clearly visible in FIG. 5A. Therefore, when the separator blade 60 attempts to move rearwardly, when the apparatus is in the 5A relationship, the separator blade 60 will contact the newspaper 46 next to the top newspaper at some point on its folded edge 47, and will either push or tear (or possibly do both) to the abutted folded newspaper 46 and will prevent the otherwise easy removal of the top newspaper 46. Also, by obstructing the full movement of the separator blade 60 and its co-acting access door 58, the whole mechanism may be caused to become jammed or otherwise fail to operate properly. FIGS. 6 & 7 illustrate a second type of blade separator malfunctioning which can result from an improper rearward adjustment setting of roller 54, even though it is properly vertically adjusted for a newspaper edition such as is shown in FIGS. 6 & 7 with each paper being thicker than the ones illustrated in FIG. 5. In FIG. 6, the roller 54 is correctly adjustably set in its vertical setting with respect to the separator blade 60 as indicated by the dimension x 2, and it is correctly adjustably set in its horizontal setting, with respect to the newspaper stop bar 39, as indicated by the dimension y 2. With these two proper adjustment settings, as indicated by dimensions x 2 and y 2, we can see that the separator blade 60 will, when moved rearwardly or toward the left, pass along the previously mentioned plane of contiguity common to the top two newspapers 46 and thereby, allow the easy removal of the top newspaper 46 only by a customer or consumer. If, however, the roller 54 is rearwardly improperly adjustably set, as indicated by the reduced dimension y 2', as illustrated in FIG. 7, (which would be properly set for a much thinner newspaper as represented in FIG. 5), we can see that the spring-biased platform 48 would, while tending to move upwardly, cause the top newspaper 46 to be pushed rearwardly, due to the roller 54 wanting to roll along the newspapers' radial edge. This action will raise the plane of movement of the separator blade 60 and will cause said separator blade 60 to push against and/or tear the pages of the second newspaper—both damaging same, and preventing the easy removal of the top newspaper 46. So, in both pairs of the exemplary FIGS., 5–5A, and 6–7, the need for the two adjustable settings of the roller 54 relative to the separator blade 60 and the newspaper stop bar 39 (both vertical and horizontal, respectively) are illustrated for emphasizing and clearly showing the proper functioning of this particular representative embodiment of the invention.

Springs 50 are selected so that when assembled in the vendor, they cause a minimal pressure to be impressed upon the top surface of the thickest newspaper.

The proper spacing of the stop means 52—that is, of the pair of rollers 54 thereof—above the plane of the separator blade 60 may be provided by various sorts of selectively adjustable vertical spacing means which may effectively include eccentric means, cam means, or crank means, such as indicated diagrammatically in composite at 104 for representative purposes only, which connect between a lower portion of the mounting carriage structure 106 and the upper rollers 54 so that operation or effective rotation thereof will not only move the rollers 54 up, but also back or to the left as viewed in FIG. 4, which is precisely what is needed and what is indicated very clearly in FIGS. 5 & 6. This particular arrangement for providing adjustment of the stop means 52 both upwardly and downwardly and rearwardly or forwardly as needed for the purposes described in detail hereinbefore may assume a wide variety of physical structures functionally equivalent to the arrangement illustrated in FIGS. 4–7 and described in detail hereinbefore and all such are intended to be included and comprehended within the broad scope of the present invention.

While the separator means, generally designated at 56 and the knife-edged separator blade 60 thereof have been described in a way clearly defining the structure thereof and its cooperative relationships with respect to the stop means 52 and the front access vending door 58 have also been clearly defined in the disclosure thereof set forth hereinbefore, for illustrative and nonlimiting purposes only, certain specific exemplary forms thereof are illustrated in the representative drawings and will be described in detail immediately hereinafter, with the express understanding that the specific description and specific illustration thereof is for said representative illustrative purposes only, and is not intended to specifically so limit the broad scope of the present invention. The comments just made with respect to the separator means 56, the stop means 52, and the front vending access door 58 are equally applicable with respect to the representative, but non-limiting structure of the stop means 52 including the rollers 54 of the stop means 52 and the adjustable spacing means indicated generally at 105 and including off-set crank-like linkage members 104 interconnecting the carriage structure 106 with a mounting frame 107 carrying upstanding spaced arm portions 108 provided with the previously-mentioned stop rollers 52 at the top thereof. Actuating means 109 is provided for adjustable effective spacing movement of the mounting frame 107 and for locking same manually in any selected position (along the curved slot 110 in the example illustrated, or by other equivalent lockable eccentric or cam) so that the mounting frame 107 will be both rearwardly and upwardly moved when it is desired to increase the vertical spacing of the stop means rollers 54 above the plane of the separator blade 60 in order to provide for proper dispensing action where each newspaper to be dispensed sequentially is substantially thicker than provided by the preceding setting of the adjustable positioning means 105 controlling the location of the stop means 52.

Please note that because of the pivotal mounting of the linkage members 104, each of the two rollers 54 of the stop means 52 is also moved toward the left at the same time that it is moved upward until it reaches an upwardly and rearwardly new off-set location such as than shown very clearly in FIG. 6, or a substantial equivalent thereof. However, it should be clearly understood that the adjustable spacing means and/or the stop means spaced thereby may be substantially varied from the specific structure particularly shown and just described in detail and all such equivalents are intended to be included and comprehended within the broad scope of the present invention.

In the exemplary but non-specifically limiting form of the invention illustrated, the previously generally designated off-set crank-like coupling or operating portion connected to the front vending access door 58 for operation thereby when the access door 58 is opened to dispense a newspaper and for correspondingly in turn itself rearwardly slideably operating the separator blade 60 on track means 64 & 64A by way of the roller means 62 & 62A is shown as comprising two similar operating portions laterally spacedly connected to the bottom edge of the front vending access door 58 and extending downwardly and rearwardly for pivotal connection to the slideable lower carriage portion 106 by way of off-set pivotally connected operating arm brackets 111 and having pivot pin means 112 interconnecting same. This is merely one arrangement for operating the separator means 60 in response to opening of the front door 58 and against the action of the return biasing spring 98. Obviously, the functional interrelationship of said parts is the significant feature, rather than the specific structures shown in the specific drawings which are exemplary and non-limiting as to said specific details thereof.

It should be noted that the arrangement illustrated in detail in the figures of the drawings and described hereinbefore is exemplary of the invention, but non-limiting as to other functionally substantially equivalent arrangements differing from the specifically disclosed features only in certain particulars but not as to basic concept. For example, the exemplary form illustrated shows the merchandise dispensing region 40 as being vertically oriented and thus shows the lower table or support 48 as being correspondingly horizontally positioned within the enclosure 26 as is the separator means 56 and the stop means 52 pressing against the top surface of the top newspaper 46 of a vertical stack of same, while the bottom surface of the bottom newspaper 46 is biased upwardly by the main biasing spring means 50. However, this rectilinear orientation of said structures within the enclosure 26 is exemplary only, and may be modified as to angular orientation within the enclosure or as to the direction of newspaper feeding movement and corresponding biasing force, or various combinations thereof. For example, the newspaper feeding movement and biasing force may be positionally reversed substantially 180° from that illustrated in the figures of the drawings so that said feeding movement and biasing force is vertically downwardly directed instead of being upwardly directed as illustrated. This would mean that the dispensed newspaper would come off the bottom of the stack and that the position of the table 48 and spacing means 52 would be positionally reversed, with the spacing means being at the bottom of the stack of newspapers and with the separator means 60 being positioned just one newspaper thickness up from the bottom positioned spacing means 52. In other words, just a reverse of the arrangement best shown in FIGS. 2 & 3 would be within the broad scope of the invention, and the downward feeding force applied to the newspapers could be a positionally reversed biasing spring 50, or a biasing weight on top of the stack of newspapers, or even the weight of the newspapers themselves—all such being within the broad scope of the present invention.

It will be readily understood that if the entire constrained assembly of stacked newspapers such as shown in FIG. 2 is essentially angularly inclined so that the separator means 56 would also be similarly angularly inclined and not truly horizontal as shown in representative, but non-limiting form in FIGS. 2 & 3, the vending apparatus would still work quite satisfactorily and such nonrectilinear arrangements are also intended to be included and comprehended within the broad scope of the invention.

It should also be noted that the stop means is not necessarily limited to two rollers, but may comprise one or more roller means functioning for substantially equivalent purposes, or may comprise relatively low surface friction pressure-plate means operable for equivalent purposes. Similar modification of the separator means 56 to facilitate its relatively non-frictional forced introduction into the space between two adjacent newspapers is also within the broad scope of the invention, and corresponding modification of the adjustable spacing means to provide the proper initial spacing between the stop means 52 and the separator means 56 may be employed in lieu of the exemplary arrangement illustrated and all such are intended to be included and comprehended within the broad scope of the present invention.

It should be noted that the two rollers 54 are indicated in a typical representative form, but are not intended to specifically so limit the invention, actually one or more rollers or other pressure plate means may be employed for the top-newspaper engagement function to be performed thereby, and it may include rollable, movable, or even very slippery engagement pressure plate means capable of functioning in the desired manner without too much frictional engagement being caused between same, and the top surface of a stacked pile of newspapers.

It should also be noted that the dual carriage portion composite best shown in FIG. 4 is also intended for exemplary purposes only, and is not intended to specifically limit the invention to that precise construction. As illustrated, it may be said that the inner pair of track members 64A comprise one effective carriage portion constrained for fore and aft longitudinal movement only, and that the rest of the structure such as the base part 107 and the upstanding ear or arm portions 106 carried thereby, effectively comprise the other relatively movable carriage portion supported entirely by the first-mentioned carriage portion, but capable of moving rearwardly, arcuately and upwardly relative to the first-mentioned carriage portion as permitted by the four pivotal supporting arms or linkage members 104 and also the arcuate slots 110 receiving the so-called manual adjustment means 109 so as to allow both upper rollers 54 to be simultaneously moved upwardly and leftwardly as viewed in FIG. 4 to effect the proper upward and leftward repositioning of said rollers needed when thicker newspapers 46 are stacked within the machine.

It should also be noted that the arrangement of the four track means 64 & 64A and the two roller mean 62 & 62A is entirely exemplary and provides merely one of several different entirely adequate fore and aft mounting arrangements, all intended to be included with the broad scope of the present invention.

The coupling pivot pin 112 is arrarged to be manually connected and disconnected as desired relative to the rear end of the effective operating or lever arm 111 so as to provide effective coupling between the front access door 58 and the carriage means 106 whenever the apparatus is initially assembed but also providing for easy disassembly thereof when a vending machine owner or operator wishes to disassemble the carriage portions from the framework and door whenever such removal is required for repair, servicing and/or maintenance purposes or for any other legitimate reason. However, this particular quick engagement and/or quick disengagement feature is not necessarily present in all forms of the invention, although it is highly advantageous.

Figure 12:
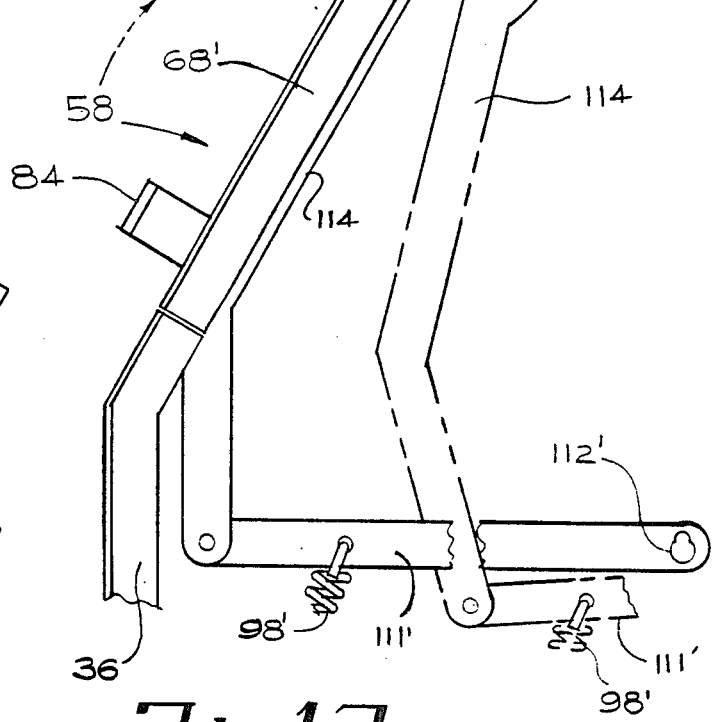
FIG. 12 is a view generally similar to FIG. 11, but illustrates a very slight modification where the front access door is hinged adjacent to its top edge, rather than adjacent to its bottom edge, but otherwise operates in a substantially equivalent manner.
Figure 11:
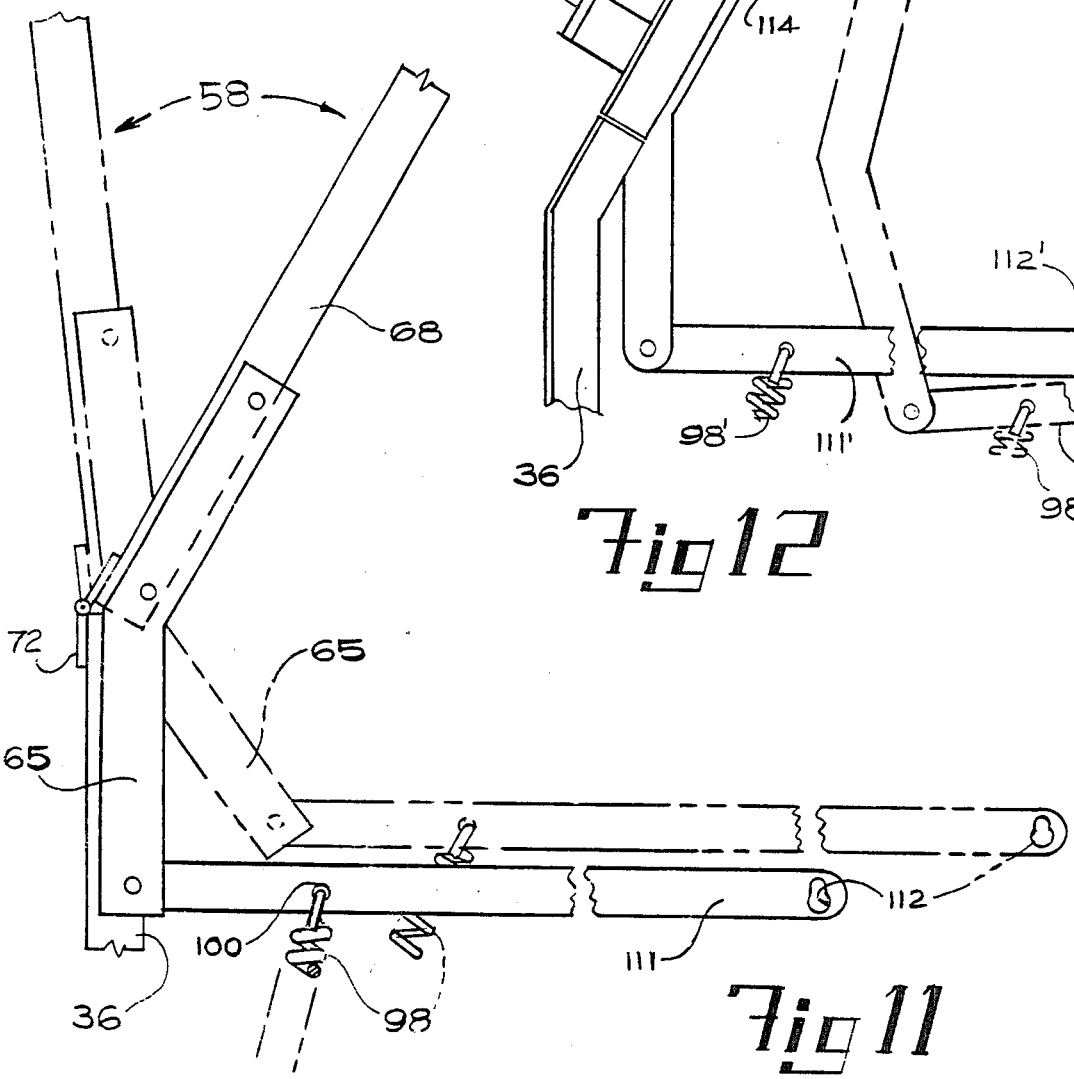
FIG. 11 is a fragmentary side view of the apparatus of FIG. 3 as seen from the reverse side thereof and showing the front access door and associated structures in the temporary open position in broken lines while showing the normal closed position thereof in solid lines.

FIG. 12 is a view very similar to FIG. 11, but illustrates a very slight modification where the front access door 58' is hinged at the top edge and opens along the bottom edge and thus, providing a reversed door arrangement as compared to the showing of FIG. 11. Similar parts are designated by similar reference numerals, primed, however, and no further detailed description is thought necessary in the light of the full description previously provided for the FIG. 11 form.

FIG. 5A is shown primarily to illustrate the necessity of the correct positioning of the rollers 54 of the stop means 52. If it is compared with the showing of FIG. 5, it can be seen that the front roller 54 is positioned too far to the left as viewed in FIG. 5A and thus, allows the extreme folded edges 47 of each of the stacked newspapers 46 to fully expand vertically to the extent shown such as to lie above the level of the horizontal plane HP. This, in itself, would not be too serious a problem, but it also allows the separation or junction plane between the two uppermost newspapers 46 to become misaligned with respect to (actually above) the horizontal movement plane of the knife blade 60 of the separator means 56, so that the apparatus would immediately jam. This is not true of the FIG. 5 showing wherein each successive newspaper 46 will be easily and readily cleanly dispensed during each subsequent dispensing operation of the front access door 58 as previously described.

The particular kind of composite movement of the stop means 52 described and illustrated in connection with the FIGS. 5, 5A, 6 & 7 is shown as being provided by first and second effective carriage portions, such as indicated generally at 105 in FIG. 4, and including the four track means 64 & 64A and cooperating roller means 62 & 62A (as first effective carriage portion) and movably cooperable with respect to the second carriage porticn 107 having upwardly extending supports 108 carrying the pair of rollers 54 (and effectively comprising the second carriage portion.) This arrangement provides for arcuate movement of the second carriage portion 107-108 and the rollers 54 in a direction coincident with the arcuate curvature of the pair of slots 110 of the upwardly extending ears of the actuating and/or locking means 109—all as best seen in FIG. 4. This composite two-part carriage means structure provides exactly the type of relative movement needed as clearly indicated in FIGS. 5, 6 & 7 and is a highly advantageous structure for this purpose.

It should be noted that the exemplary structure illustrated is for representative purposes only, and is not intended to specifically limit the invention to some of the specific details thereof, as illustrated and as now described with respect to said exemplary, but non-limiting version only.

For example, a preferred form of the upper stop rollers 54 is to form them of a transparent material, such as glass or any of the various transparent forms of plastic material, or any other substantial equivalent thereof. This is desirable, because it does not obstruct the view of a would-be purchaser of a newspaper, when he looks through the transparent windows of the closed vending machine prior to deciding to purchase a newspaper.

It should be noted that the front reference position for the folded edges 47 of a stack of newspapers 46 is shown as comprising the upstanding front stop member 39 which may be attached to the frame or housing, or otherwise appropriately fixedly mounted, but not limited to the specific structure shown.

Figure 9:
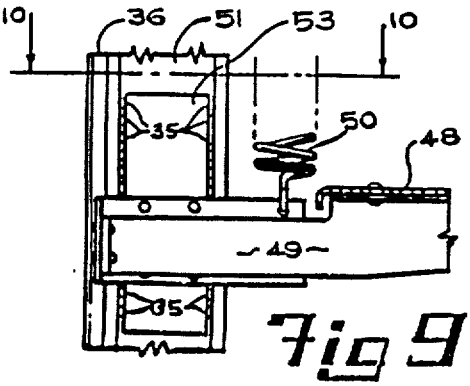
FIG. 9 is a fragmentary partially broken away, partially sectional and partially elevational view of the central portion of the apparatus as seen from an aspect similar to the showing of FIG. 2, but enlarged somewhat, and fragmentarily showing the biasing means for biasing the platform or table upon which the stacked newspapers are to be placed.
Figure 10:
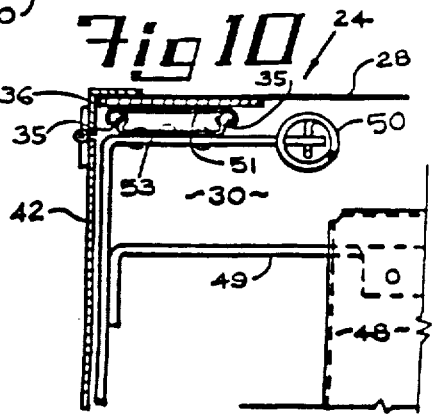
FIG. 10 is a fragmentary view partly comprising a crosssectional view and partly comprising a plan view taken substantially along the plane and in the direction of the arrows 10—10 of FIG. 9.
Figure 8:
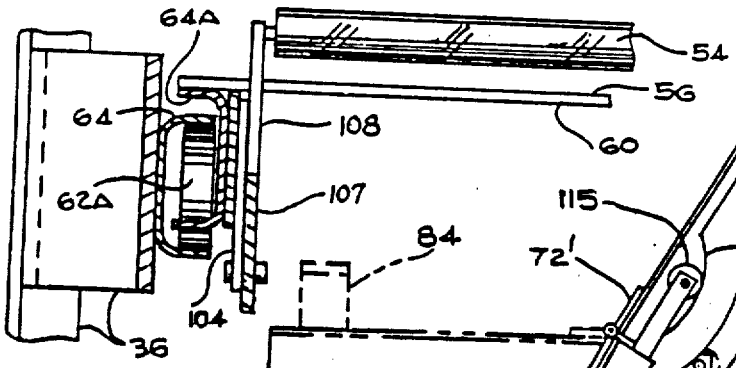
Figure 12:
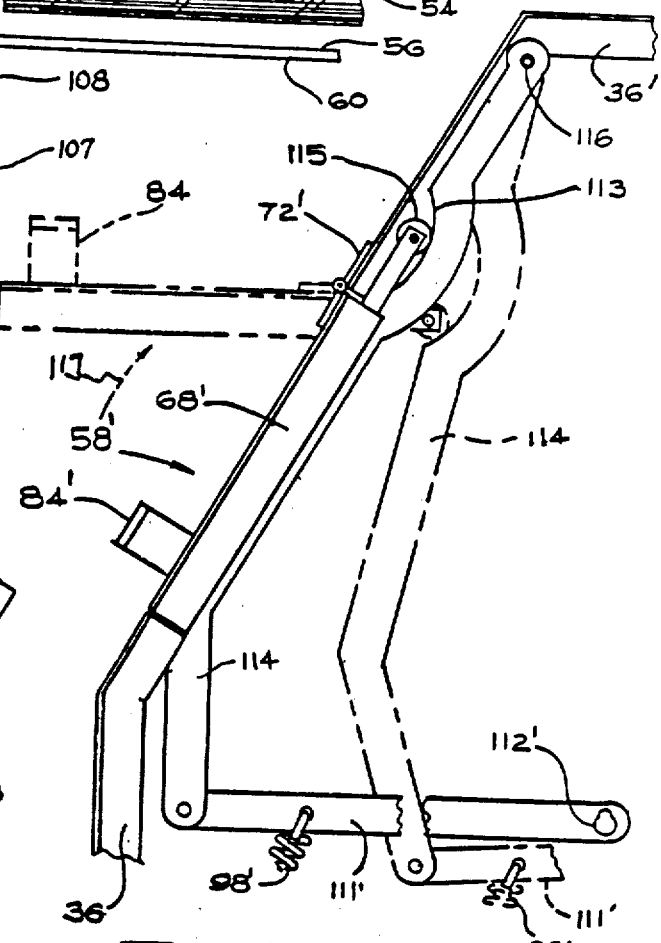
Figure 11:
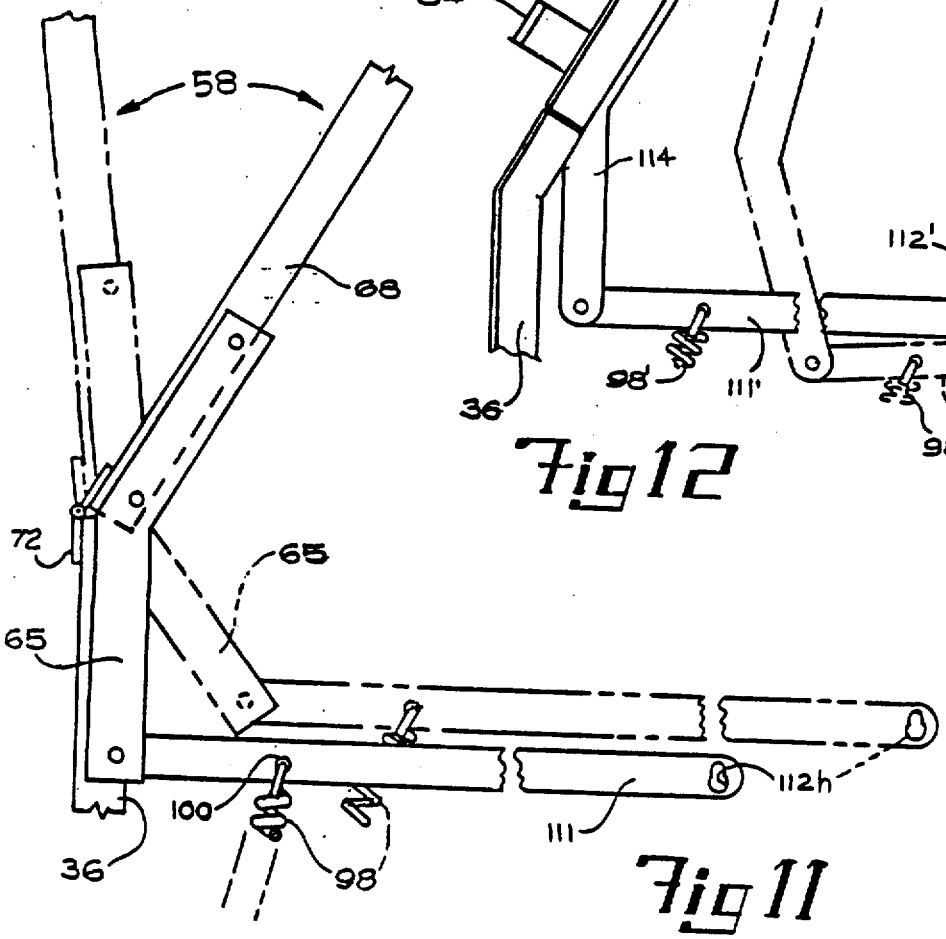
Figures 4, 5, 5A, 6, 7:
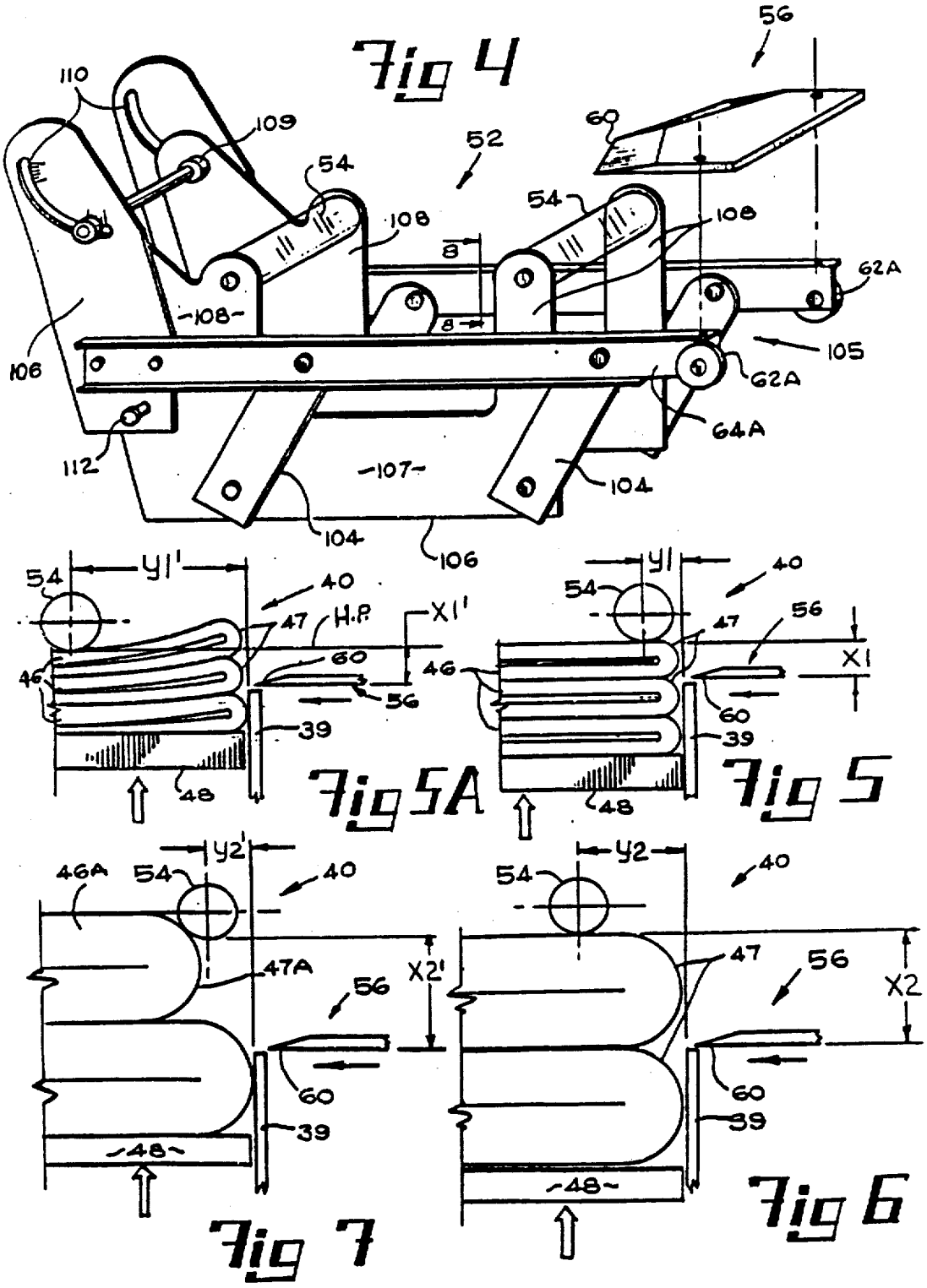
Figure 1:
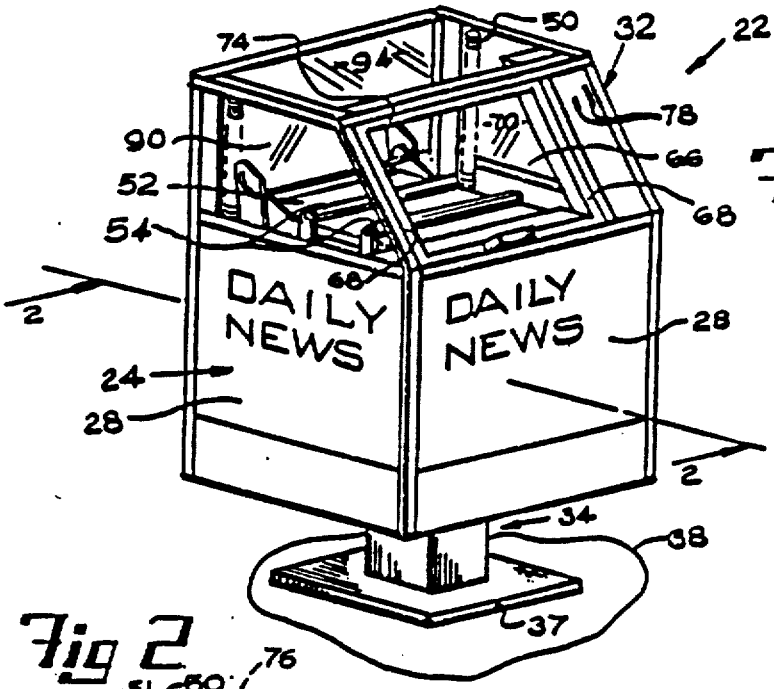
Figure 2:
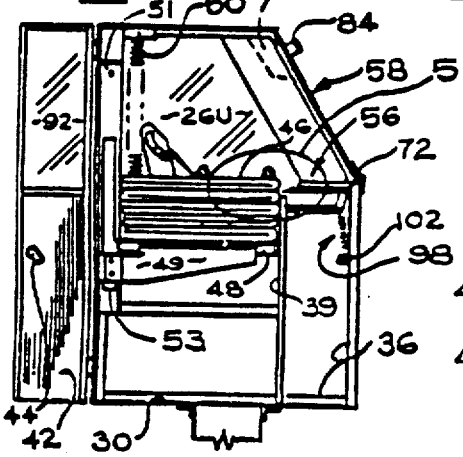
Figure 3:
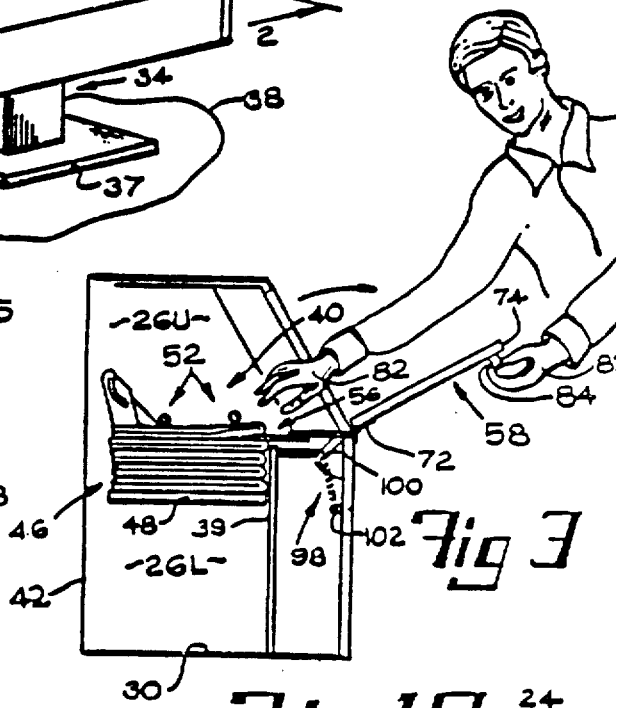
Figure 9:
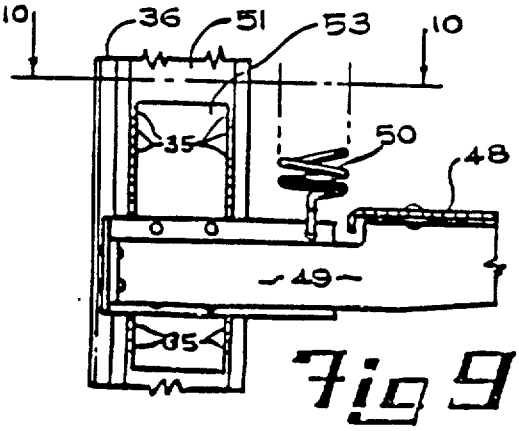
Figure 10:
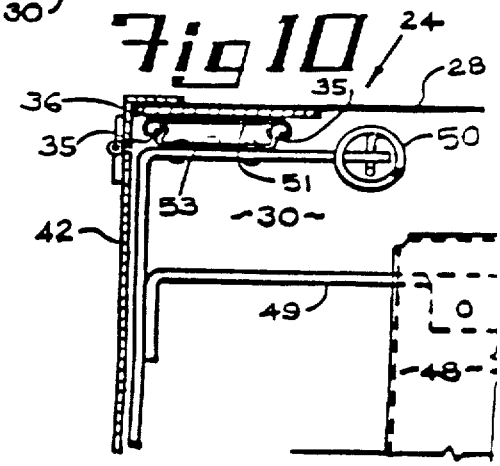
Figure 4:
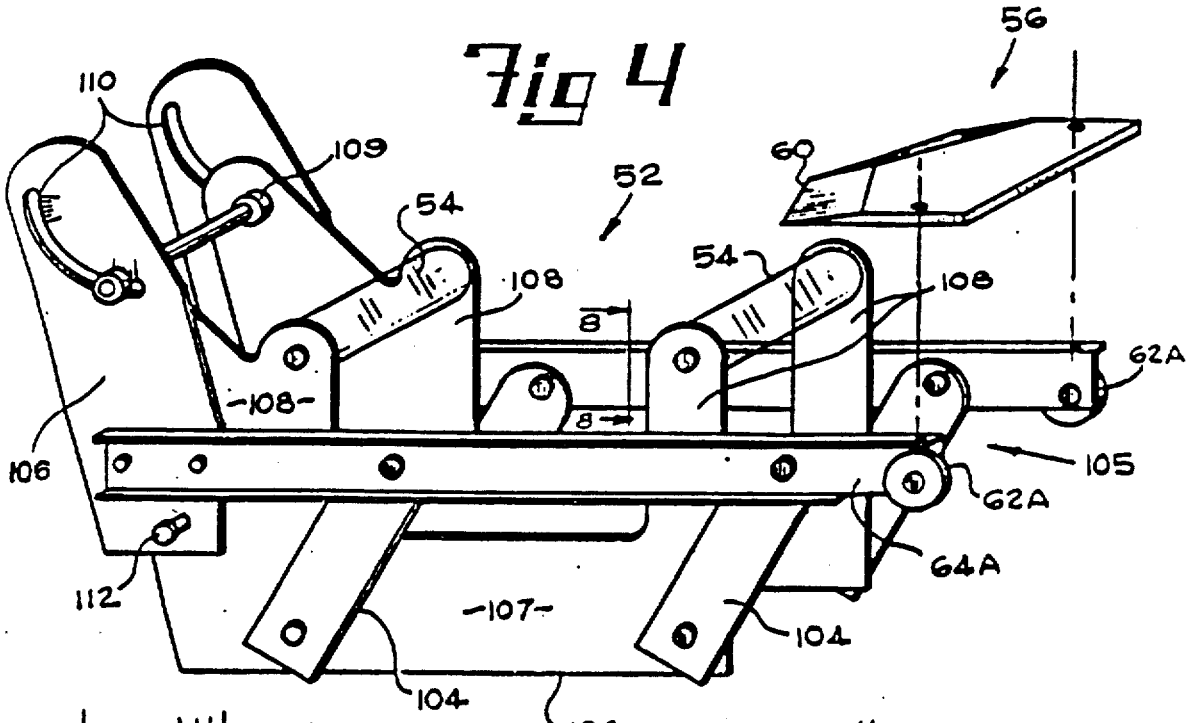
Figure 5A:
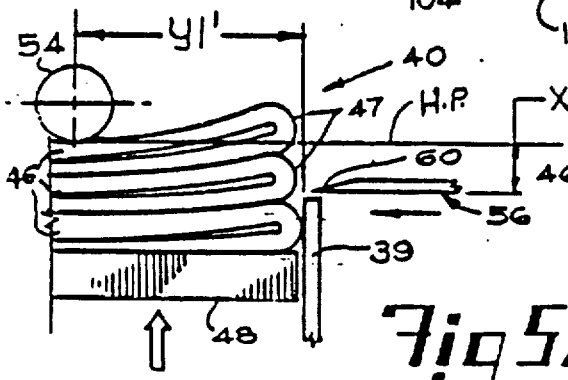
Figure 5:
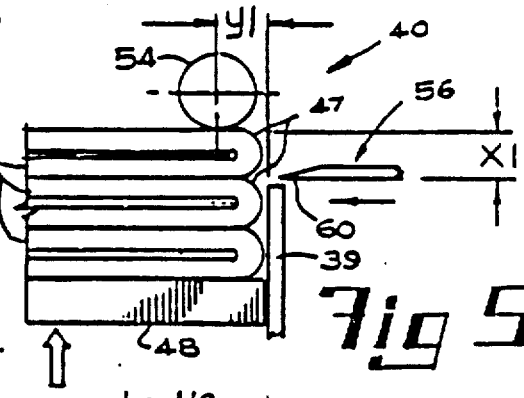
Figure 7:
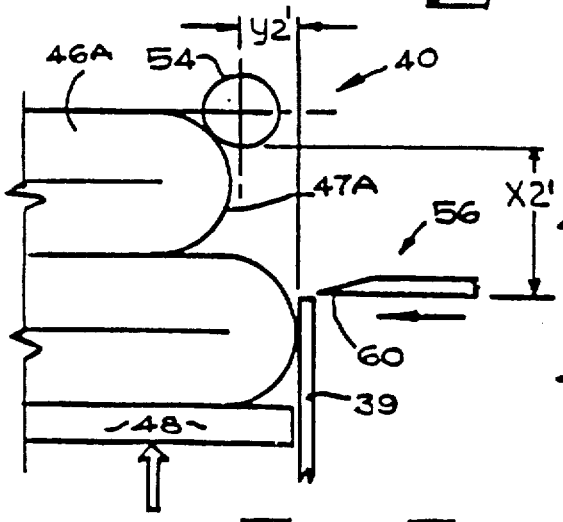
Figure 6:
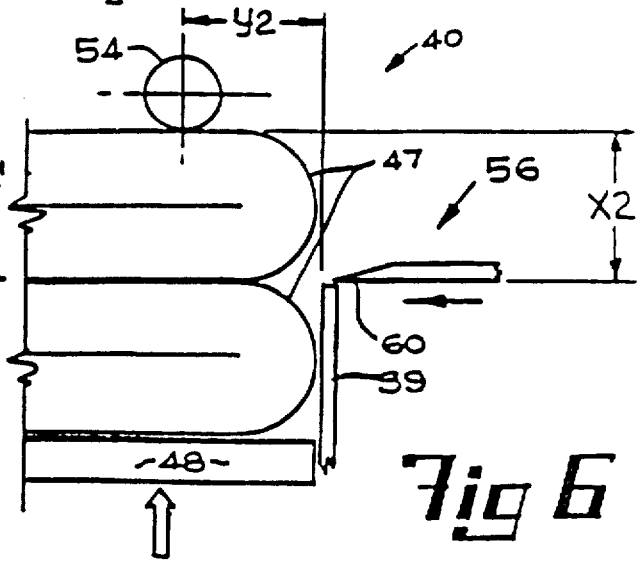
Figure 8:
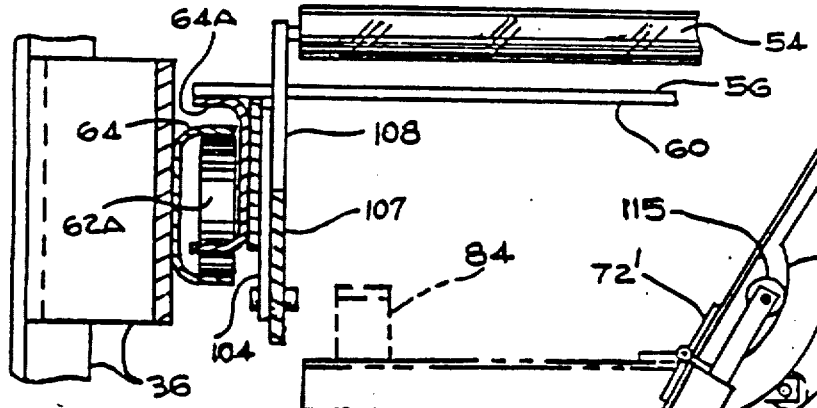
Figure 12:
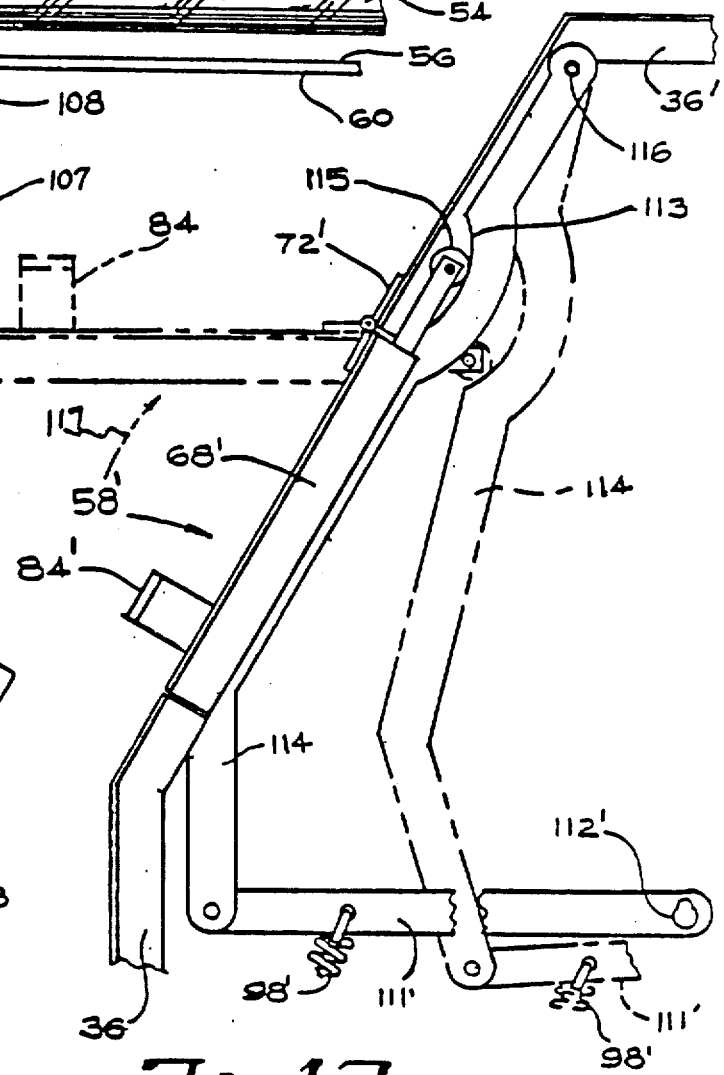
Figure 11:
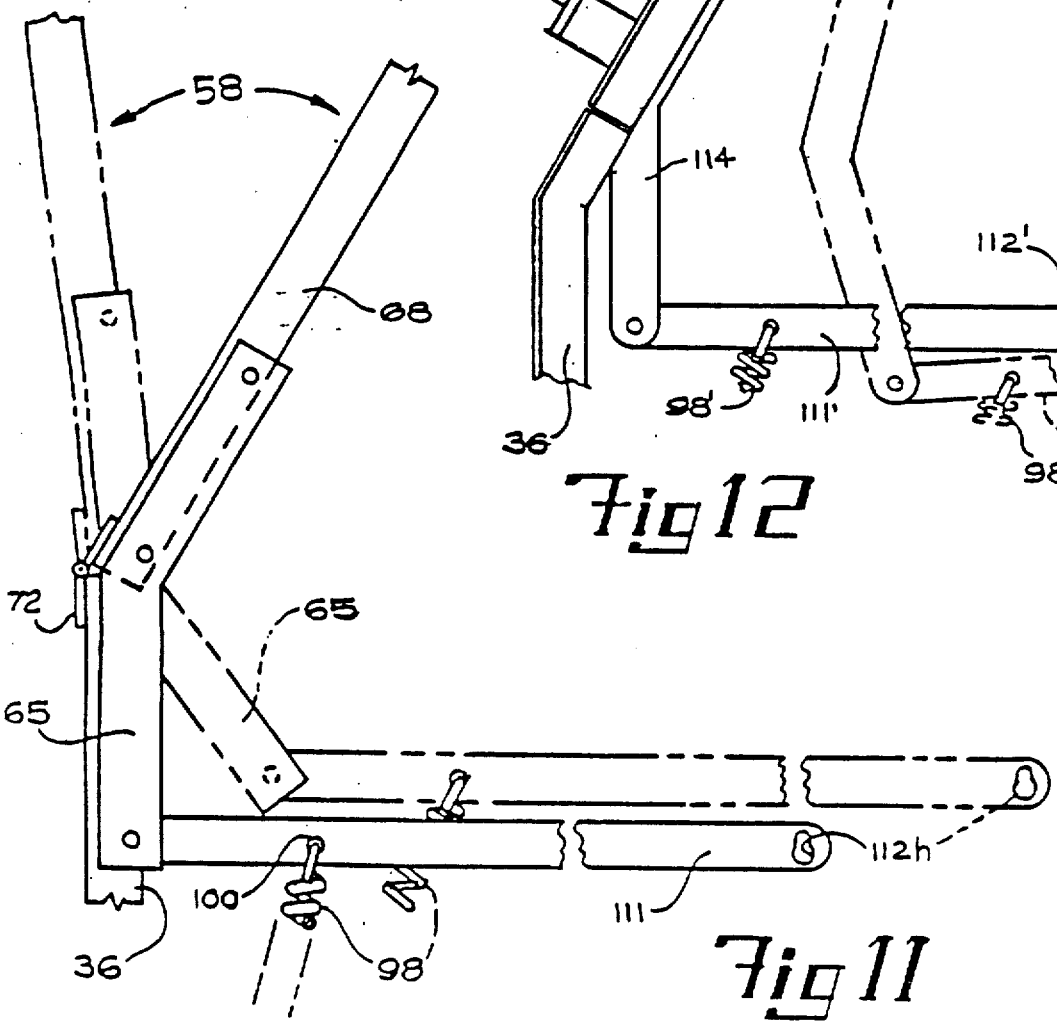

The biasing spring means 50 is illustrated as a tension spring connected to a mounting arm 49 attached to the platform 48, or otherwise effectively placed to bear upwardly thereagainst, or to effectively upwardly bias the entire stack of newspapers 46. As illustrated, the platform 48 and the connecting arm 49 upwardly biased by the spring 50 are appropriately vertically slideably mounted for the required vertical loading and subsequent sequential newspaper dispensing operations. As shown in the specific form illustrated, this comprises two cooperating vertical slide members 51 & 53, with the member 51 being fixedly mounted and the member 53 having relatively vertically slideably mounted with respect to the fixed member 51 and having balls of the ball bearing type effectively cooperating therewith to function as anti-friction means and with the balls being indicated at 37 as best shown in FIGS. 9 & 10, but with the invention not being specifically limited thereto.

In FIG. 12, the mounting of the access door 58' is reversed, so as to be hinged at the top, instead of at the bottom and while it, in one form, can operate the separator blade 60 in the manner previously described by merely making minor modifications in the linkage members connecting the access door 58' to the pivot pin 112 as shown in FIG. 4, for purposes of variety, the specific structure of FIG. 12 is shown with a slight modification including a cam 115 connected to the top end edge of the access door 58', and which cooperates with a curved cam follower 113 on a lever arm, or linkage member 114, which is top-pivoted at 116 to a frame portion 36'. The normal closed door position of the access door 58' is shown in solid lines, as are the positions of the just-described parts 115, 113, 114, & 116. As soon as the access door 58' is manually swung outwardly and upwardly in an opening direction, as is shown by the directional arrow 117 in FIG. 12, into a fully-open position as is shown in broken lines in FIG. 12, the previously-mentioned cam 115 is pivoted in a clockwise direction around the access of the upper hinge 72' into the broken line position shown in FIG. 12, which causes the cam 115 to roll along the concave surface of the cam follower 113 so as to force it toward the right and into the broken line position shown in FIG. 12. This causes the linkage member or connecting arm 111' to be moved from its normal solid line closed position toward the right, and to its broken line activated position as shown in FIG. 12, which, will cause the other end of the activated lower arm or linkage member 111' to move toward the right in the same manner as that previously described with respect to FIG. 11 of the first form of the invention for the corresponding linkage member or arm 111 shown therein. Thus, the engagement hole 112' at the right end of the connecting arm or linkage member 111' of FIG. 12 will be adpated to engage and rearwardly activate and forcibly move the engagement pin 112 shown in FIG. 4, which will bring about rearward operation of the separator blade 60 in the manner previously-described in detail in connection with the first form of the invention. This is merely representative, but not specifically limiting modification form of the newspaper access door 58', and it may assume various other substantially equivalent modifications within the broad scope of the present invention.

It should also be noted that the coin-receiving means 32 is only illustrative, and not limiting and may be replaced by any of several other well-known types of such coin-receiving effective unlocking mechanism including among others, types where the coin is externally received, and is physically manually moved into interior coin-discharging relationship, or other substantial equivalent thereof. Also, in certain forms, no coin may be required and it may be merely manually initiated, and is to be considered as an equivalent.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to include substantially equivalent constructions embodying the basic teachings and inventive concept of the present invention.

What is claimed is:

1. A novel vending machine for sequentially and selectively dispensing and vending each one of a plurality of substantially similarly shaped, flat, merchandise objects each of substantially parallelopiped shape in an object-size-adjustable manner, comprising: a hollow housing defining therein an enclosure having a predetermined length dimension, a predetermined transversely perpendicular width dimension and a predetermined depth dimension perpendicular to both said length dimension and said width dimension, whereby to cause said enclosure to include a merchandise-storage portion of substantially paraallelopiped shape and of a selected length, width, and depth such as to be large enough for interior storage of a plurality of depth-direction stacked similar merchandise objects, each of a similar substantially flat configuration, each having a predetermined length and width substantially less than the corresponding length and width dimension of said hollow enclosure, and each having a depth and thickness dimension which is only a small fraction of the depth dimension of said hollow enclosure, thereby providing for the depth-direction stacked superimposition of a plurality of such similar merchandise objects within said enclosure in depth-direction stacked relationship with the length and width dimension of each such merchandise object lying in a transverse plane; a transverse substantially flat supporting platform or table cooperable to receive said plurality of similar depth-direction stacked transversely oriented merchandise objects thereon within said hollow enclosure and being provided with an opposite-to-depth-direction directed biasing spring means cooperable with said transverse supporting platform or table and also cooperable with a fixed connection point thereof relative to the interior of said housing means for normally forcing said stacked plurality of similar merchandise objects in the biased opposite-to-depth direction substantially perpendicular to the transverse orientation of each of said merchandise objects; controllably adjustable stop means positioned in a manner spaced from said supporting platform or table and with an adjustable spaced relationship therebetween in an opposite-to-said depth direction manner such as to allow a desired number of stacked merchandise objects to be positioned between said supporting platform or table and said spaced stop means; separator means positioned within said hollow enclosure and transversely adjacent to a merchandise dispensing region defined between said supporting platform or table and said spaced stop means whereby to be immediately transversely adjacent to such a stacked assembly of said merchandise objects and displaced in said depth direction by a distance corresponding to the depth and thickness dimension of one of such merchandise objects and controllably manually extensible from a normal at-rest position into a manually caused activation position with said separator being forced between an end one only of such a plurality of stacked merchandise objects whereby to cause an end one of said merchandise objects to be effectively segregated from the remainder of the stacked merchandise objects so the end one of said merchandise objects is in a condition to be manually removed from the hollow enclosure; a manually openable access door carried by said housing means and provided with coin-openable locking means normally locking said access door in closed relationship with respect to said housing means; and exteriorly accessible coin-receiving means carried by said housing means and coupled to said coin-openable locking means cooperable to unlock said access door whereby to allow it to be manually opened, causing the separator means to segregate the end one of such a plurality of stacked merchandise objects from the remainder thereof and readily accessible to the hand of a person inserted through the temporarily opened access door into the merchandise-dispensing region to allow manual removal in a transverse horizontal direction of the end one only of said plurality of stacked merchandise objects;

said adjustable stop means including first and second effective carriage portions movably coupled relative to each other and effectively comprising composite carriage means, with said first portion being coupled to and effectively movable with said separator means and with said second carriage portion being coupled to the rest of said controllably adjustable stop means for relative movement upward and rearward, and for opposite reverse return movement, to provide increased rearward offset positioning of said controllably adjustable stop means for relative movement upward and rearward, and for opposite reverse return movement, to provide increased rearward offset positioning of said controllably adjustable stop means whenever it has its underlying vertical spacing for thicker stacked merchandise objects increased relative to said separator means.

2. Vending apparatus as defined in claim 1, wherein said stop means comprises roller means adapted to press against the end surface of an end one of said stacked merchandise objects when in machine-loaded position ready for a subsequent single-merchandise-article-dispensing operation, whereby to facilitate the free rolling transeverse lateral dispensing movement and removal of an end one only of said stacked plurality of merchandise objects.

3. Vending apparatus as defined in claim 1, wherein said housing means has a transparent viewing portion encompassing and defining a viewing region positioned adjacent to an end one of said stacked plurality of merchandise articles for exterior viewing thereof by a prospective purchaser thereof.

4. Vending apparatus as defined in claim 1, wherein said stop means comprises roller means adpated to press against the end surface of an end one of said stacked merchandise objects when in machine-loaded position ready for a subsequent single-merchandise-article -dispensing operation, whereby to facilitate the free rolling transverse lateral dispensing movement and removal of an end one only of said stacked plurality of merchandise objects, and wherein said housing means has a transparent viewing portion encompassing and defining a viewing region positioned adjacent to an end one of said stacked plurality of merchandise articles for exterior viewing thereof by a prospective purchaser thereof.

5. Vending apparatus as defined in claim 1, wherein said flat supporting platform or table lies in a horizontal plane and wherein said stop means also lies in a upwardly spaced horizontal plane from said supporting platform or table whereby to cause said depth-direction stacked transversely-oriented merchandise objects therebetween to effectively comprise vertically stacked horizontally oriented merchandise objects having said end merchandise object which is to be dispensed comprising an uppermost horizontally positioned one of said merchandise objects which is to be effectively segregated by horizontal operation of said separator means from the remainder of said vertically stacked merchandise objects therebelow so the dispensible end one of said merchandise objects comprises the uppermost horizontally positioned one thereof and is in a position to be manually substantially horizontally removed from the hollow enclosure.

6. A novel vending machine for sequentially and selectively dispensing and vending each one of a plurality of substantially similarly shaped, flat, merchandise objects in an object-size-adjustable manner, comprising: a hollow housing defining therein an enclosure having a predetermined length dimension, a predetermined transversely perpendicular width dimension, and a predetermined transversely perpendicular width dimension and a predetermined depth dimension perpendicular to both said length dimension and said width dimension, whereby to cause said enclosure to include a merchandise-storage portion of substantially parallelopiped shape and of a selected length, width, and depth such as to be large enough for interior storage of a plurality of depth-direction stacked similar merchandise objects, each of a similar substantially flat configuration, each having a predetermined length and width substantially less than the corresponding length and width dimension of said hollow enclosure, and each having a depth and thickness dimension which is only a small fraction of the depth dimension of said hollow enclosure, thereby providing for the depth-direction stacked superimposition of a plurality of such similar merchandise objects within said enclosure in depth-direction stacked relationship with the length and width dimension of each such merchandise object lying in a transverse plane; a transverse substantially flat supporting platform or table cooperable to receive said plurality of similar depth-direction stacked transversely oriented merchandise objects thereon within said hollow enclosure and being provided with an opposite-to-depth-direction direction biasing spring means cooperable with said transverse supporting platform or table and also cooperable with a fixed connection point thereof relative to the interior of said housing means for normally forcing said stacked plurality of similar merchanside objects in the biased opposite-to-depth direction substantially perpendicular to the transverse orientation of each of said merchandise objects; controllably adjustable stop means positioned in a manner spaced from said supporting platform or table and with an adjustable spaced relationship therebetween in an opposite-to-said depth direction manner such as to allow a desired number of stacked merchandise objects to be positioned between said supporting platform or table and said spaced stop means; separator means positioned within said hollow enclosure and transversely adjacent to a merchandise-dispensing region defined between said supporting platform or table and said spaced stop means whereby to be immediately transversely adjacent to such a stacked assembly of said merchandise objects and displaced in said depth direction by a distance corresponding to the depth and thickness dimension of one of such merchandise objects and controllably manually extensible from a normal at-rest position into a manually caused activation position with said separator being forced between an end one only of such a plurality of stacked merchandise objects whereby to cause an end one of said merchandise objects to be effectively segregated from the remainder of the stacked merchandise objects fo the end one of said merchandise objects is in a condition to be manually removed from the hollow enclosure; a manually openable access door carried by said housing means and provided with controllably openable locking means normally locking said access door in closed relationship with respect to said housing means;

said stop means being mounted for said relative movement in two different substantially mutually perpendicular directions, comprising an up-and-down, depth direction, and a rearward-and-forward, front-to-rear, and vice versa, length direction relative to a neutral position adjacent to, and transversely spaced a predetermined distance from, an at-rest position of the leading edge of said separator means.

7. Vending apparatus as defined in claim 6, wherein said stop means comprises roller means adapted to press against the end surface of an end one of said stacked merchanside objects when in machine-loaded position ready for a subsequent single-merchandise-article-dispensing operation, whereby to facilitate the free rolling transverse lateral dispensing movement and removal of an end one only of said stacked plurality of merchandise objects.

8. Vending apparatus as defined in claim 6, wherein said housing means has a transparent viewing portion encompassing and defining a viewing region positioned adjacent to an end one of said stacked plurality of merchandise articles for exterior viewing thereof by a prospective purchaser thereof.

9. Vending apparatus as defined in claim 6, wherein said stop means comprises roller means adapted to press against the end surface of an end one of said stacked merchandise objects when in machine-loaded position ready for a subsequent single-merchanside-article-dispensing operation, whereby to facilitate the free rolling transverse lateral dispensing movement and removal of an end one only of said stacked plurality of merchandise objects, and wherein said housing means has a transparent viewing portion encompassing and defining a viewing region positioned adjacent to an end one of said stacked plurality of merchandise articles for exterior viewing thereof by a prospective purchaser thereof.

10. Vending apparatus as defined in claim 6, wherein said flat supporting platform or table lies in a horizontal plane and wherein said stop means also lies in an upwardly spaced horizontal plane from said supporting platform or table whereby to cause said depth-direction stacked transversely-oriented merchandise objects therebetween to effectively comprise vertically stacked horizontally oriented merchandise objects having said end merchansdise object which is to be dispensed comprising an uppermost horizontally positioned one of said merchandise objects which is to be effectively segregated by horizontal operation of said separator means from the remainder of said vertically stacked merchandise objects therebelow so the dispensible end one of said merchanside objects comprises the uppermost horizontally positioned one thereof and is in a position to be manually substantially horizontally removed from the hollow enclosure.

11. Vending apparatus as defined in claim 6, wherein said stop means is further provided with variable stop scale indicating the magnitude of said movement of said stop means relative to said neutral position.

12. Vending apparatus as defined in claim 9, wherein said stop means is further provided with variable stop scale means indicating the magnitude of said relative movement of said roller means of said stop means in one of said two different directions relative to the other one of said two different directions and relative to said neutral position.

13. Vending apparatus as defined in claim 9, wherein said roller means of said stop means is formed of transparent material for facilitating the viewing of underlying stacked merchandise objects.

* * * * *

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

The title page should be deleted to appear as per attached title page.

Sheets 1 of 3 through 3 of 3 of the Drawings should be deleted to appear as per attached sheets.

United States Patent [19]

Dahl

[11] Patent Number: 4,756,448

[45] Date of Patent: Jul. 12, 1988

[54] VENDING MACHINE FOR VENDING ONE-AT-A-TIME MERCHANDISE ARTICLES OF A PLURALITY OF SIMILAR SUCH MERCHANDISE OBJECTS, EACH OF A SUBSTANTIALLY RECTANGULAR PARALLELOPIPED SHAPE, SUCH AS A NEWSPAPER, MAGAZINE, OR THE LIKE

[76] Inventor: Frank L. Dahl, 5248 W. 119th Pl., Inglewood, Calif. 90304

[21] Appl. No.: 906,134

[22] Filed: Sep. 11, 1986

[51] Int. Cl.[4] ..... G07F 11/14

[52] U.S. Cl. ..... 221/4; 221/155; 221/229; 221/241

[58] Field of Search ..... 221/65, 155, 228, 229, 221/241, 249, 279, 4

[56] References Cited

U.S. PATENT DOCUMENTS

| | | | |
|---|---|---|---|
| 3,705,665 | 12/1972 | Gunzler | 221/279 X |
| 3,749,281 | 7/1973 | Stovers et al. | 221/279 X |
| 4,530,444 | 7/1985 | Christian | 221/241 X |

*Primary Examiner*—F. J. Bartuska

[57] ABSTRACT

A novel vending machine for sequentially and selectively dispensing and vending in a merchandise dispensing region each one of a plurality of substantially similarly-shaped flat merchandise objects (usually each of substantially parallelopiped shape, such as that of a newspaper, magazine, or the like, although not specifically so limited) in an object-size-adjustable manner making it possible to quickly and easily initially adjust the apparatus to correspond to a particular thickness of depth-direction dimension of each of the merchandise objects which are to be dispensed so the dispensing apparatus is set exactly for that particular thickness of each of the similar merchandise objects; and conversely, being just as easily being differently adjusted for the appropriate sequential dispensing of each one of a plurality of different merchandise objects having completely different thicknesses in each case than in the first-mentioned case; and capable of easy adjustment into any intermediate adjusted relationship suitable for handling and easy dispensing of each one of a plurality of merchandise objects having a different thickness lying between the two extremes already mentioned.

13 Claims, 3 Drawing Sheets

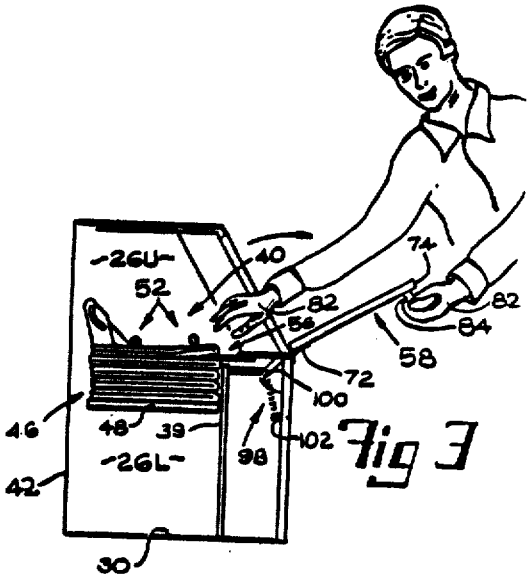

Fig 3

110
109
54
52
60
56
108
8
62A
105
106
112
107
104
64A y1'
40
47
H.P.
X1'
46
39
48 y1
X1 y2'
46A
47A
X2' y2
X2

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

In the drawings, Sheet 1, Fig. 2, the reference numeral (and broken-line arrow) 76* should be applied to the door locking means carried at the top of the coin-receiving means 32 (best shown in Fig. 1), as is clearly shown on the accompanying corrected (replacement) sheet 1 of the drawings; and In the drawings, Sheet 1, Fig. 3, the reference numeral (and lead line) 82 should be <u>additionally</u> applied to the operator's <u>left</u> hand, as is clearly shown on the accompanying corrected (replacement) Sheet 1 of the drawings; and In the drawings, Sheet 1, Fig. 9, the reference numerals (and lead lines) 35 should be applied to the ball-bearing balls rotatably confined between the fixed member 51 and the relatively vertically slidable member 53, as is clearly shown on the accompanying corrected (replacement) Sheet 1 of the drawings; and

UNITED STATES PATENT AND TRADEMARK OFFICE

CERTIFICATE OF CORRECTION

PATENT NO. : 4, 756,448

DATED : July 12, 1988

INVENTOR(S) : Frank L. Dahl

It is certified that error appears in the above-identified patent and that said Letters Patent is hereby corrected as shown below:

In the drawings, Sheet 1, Fig. 10, the reference numerals (and lead lines) 35 should be applied to the ball-bearing balls rotatably confined between the fixed member 51 and the relatively vertically slidable member 53, as is clearly shown on the accompanying corrected (replacement) Sheet 1 of the drawings.

In the drawings, Sheet 2, Fig. 4, the section-indicating numerals 8-8 (and the associated arrows and section-plane-indicating vertical plane line) should be applied vertically across the middle of the rear one of the two parallel longitudinal track means members 64 & 64A, as is clearly shown on the accompanying corrected (replacement) Sheet 2 of the drawings; and In the drawings, Sheet 2, Fig. 5, the dimension-indicating reference characters X1 & Y1 (and associated demarcation lines and arrows) should be applied as described in the specification, in the appropriate blank spaces on the incorrect published drawing, as is clearly shown on the accompanying (replacement) Sheet 2 of the drawings; and In the drawings, Sheet 2, Fig. 5A, the dimension-indicating reference characters X1' & Y1' (and associated demarcation lines and arrows) should be applied as described in the specification, in the appropriate blank spaces on the incorrect published drawing, as is clearly shown on the accompanying (replacement) Sheet 2 of the drawings; and In the drawings, Sheet 2, Fig. 6, the dimension-indicating reference characters X2 & Y2 (and associated demarcation lines

UNITED STATES PATENT AND TRADEMARK OFFICE

CERTIFICATE OF CORRECTION

PATENT NO. : 4, 756,448

DATED : July 12, 1988

INVENTOR(S) : Frank L. Dahl

It is certified that error appears in the above-identified patent and that said Letters Patent is hereby corrected as shown below:

and arrows) should be applied, as described in the specification, in the appropriate blank spaces on the incorrect published drawing, as is clearly shown on the accompanying (replacement) Sheet 2 of the drawings; and In the drawings, Sheet 2, Fig. 7, the dimension-indicating reference characters X2' & Y2' (and associated demarcation lines and arrows) should be applied, as described in the specification, in the appropriate blank spaces on the incorrect published drawing, as is clearly shown on the accompanying (replacement) Sheet 2 of the drawings.

In the drawings, Sheet 3, Fig. 11, the present reference numeral 112 should be changed to 112b (meaning hole - - or slot-) so as to avoid being confused with the pin 112 shown in Fig. 4 (and with which it is adapted to be removably engaged); said correction being shown on the accompanying (replacement) Sheet 3 of the drawings.

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

In Column 1, line 30 of the patent, cancel "arr" and insert - - art - - .

In Column 3, line 5 of the patent, before "merchandise" insert - - a - - .

In Column 5, line 36 of the patent, before "taken" insert - - be - - .

In Column 7, line 13 of the patent, cancel "lyipg" and insert - - lying - - .

In Column 8 of the patent, after "illustrated" insert a comma - - , - -;

In Column 9, line 42 of the patent, cancel "lay" and insert - - by - -.

In Column 10, line 21 of the patent, cancel "1" and insert - - 112 - -.

In Column 12, line 56 of the patent, cancel "is" and insert - - as - - .

In Claim 6, (Column 22, line 40 of the patent), cancel "direction" (second occurrence) and insert - - directed - -.

Signed and Sealed this

Seventh Day of February, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

The title page should be deleted to appear as per attached title page.

Sheets 1 of 3 through 3 of 3 of the Drawings should be deleted to appear as per attached sheets.

United States Patent [19]

Dahl

[11] Patent Number: 4,756,448

[45] Date of Patent: Jul. 12, 1988

[54] VENDING MACHINE FOR VENDING ONE-AT-A-TIME MERCHANDISE ARTICLES OF A PLURALITY OF SIMILAR SUCH MERCHANDISE OBJECTS, EACH OF A SUBSTANTIALLY RECTANGULAR PARALLELOPIPED SHAPE, SUCH AS A NEWSPAPER, MAGAZINE, OR THE LIKE

[76] Inventor: Frank L. Dahl, 5248 W. 119th Pl., Inglewood, Calif. 90304

[21] Appl. No.: 906,134

[22] Filed: Sep. 11, 1986

[51] Int. Cl.[4] ..... G07F 11/14

[52] U.S. Cl. ..... 221/4; 221/155; 221/229; 221/241

[58] Field of Search ..... 221/65, 155, 228, 229, 221/241, 249, 279, 4

[56] References Cited

U.S. PATENT DOCUMENTS

| | | | |
|---|---|---|---|
| 3,705,665 | 12/1972 | Gunzler | 221/279 X |
| 3,749,281 | 7/1973 | Stovers et al. | 221/279 X |
| 4,530,444 | 7/1985 | Christian | 221/241 X |

*Primary Examiner*—F. J. Bartuska

[57] ABSTRACT

A novel vending machine for sequentially and selectively dispensing and vending in a merchandise dispensing region each one of a plurality of substantially similarly-shaped flat merchandise objects (usually each of substantially parallelopiped shape, such as that of a newspaper, magazine, or the like, although not specifically so limited) in an object-size-adjustable manner making it possible to quickly and easily initially adjust the apparatus to correspond to a particular thickness of depth-direction dimension of each of the merchandise objects which are to be dispensed so the dispensing apparatus is set exactly for that particular thickness of each of the similar merchandise objects; and conversely, being just as easily being differently adjusted for the appropriate sequential dispensing of each one of a plurality of different merchandise objects having completely different thicknesses in each case than in the first-mentioned case; and capable of easy adjustment into any intermediate adjusted relationship suitable for handling and easy dispensing of each one of a plurality of merchandise objects having a different thickness lying between the two extremes already mentioned.

13 Claims, 3 Drawing Sheets

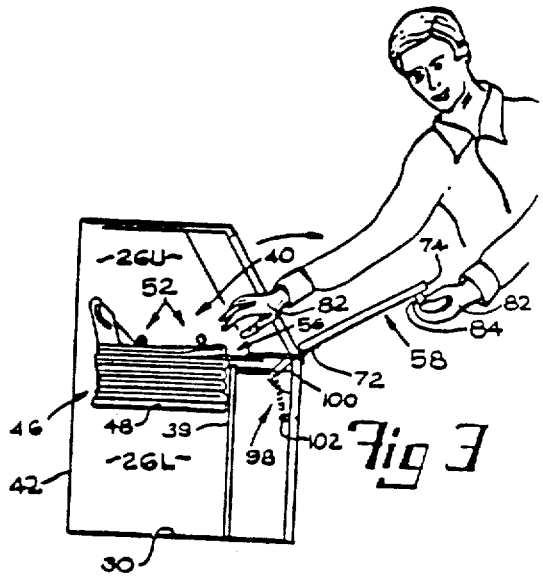

Fig 3

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

In the drawings, Sheet 1, Fig. 2, the reference numeral (and broken-line arrow) 76* should be applied to the door locking means carried at the top of the coin-receiving means 32 (best shown in Fig. 1), as is clearly shown on the accompanying corrected (replacement) sheet 1 of the drawings; and In the drawings, Sheet 1, Fig. 3, the reference numeral (and lead line) 82 should be additionally applied to the operator's left hand, as is clearly shown on the accompanying corrected (replacement) Sheet 1 of the drawings; and In the drawings, Sheet 1, Fig. 9, the reference numerals (and lead lines) 35 should be applied to the ball-bearing balls rotatably confined between the fixed member 51 and the relatively vertically slidable member 53, as is clearly shown on the accompanying corrected (replacement) Sheet 1 of the drawings; and

UNITED STATES PATENT AND TRADEMARK OFFICE

CERTIFICATE OF CORRECTION

PATENT NO. : 4, 756,448

DATED : July 12, 1988

INVENTOR(S) : Frank L. Dahl

It is certified that error appears in the above-identified patent and that said Letters Patent is hereby corrected as shown below:

In the drawings, Sheet 1, Fig. 10, the reference numerals (and lead lines) 35 should be applied to the ball-bearing balls rotatably confined between the fixed member 51 and the relatively vertically slidable member 53, as is clearly shown on the accompanying corrected (replacement) Sheet 1 of the drawings.

In the drawings, Sheet 2, Fig. 4, the section-indicating numerals 8-8 (and the associated arrows and section-plane-indicating vertical plane line) should be applied vertically across the middle of the rear one of the two parallel longitudinal track means members 64 & 64A, as is clearly shown on the accompanying corrected (replacement) Sheet 2 of the drawings; and In the drawings, Sheet 2, Fig. 5, the dimension-indicating reference characters X1 & Y1 (and associated demarcation lines and arrows) should be applied as described in the specification, in the appropriate blank spaces on the incorrect published drawing, as is clearly shown on the accompanying (replacement) Sheet 2 of the drawings; and In the drawings, Sheet 2, Fig. 5A, the dimension-indicating reference characters X1' & Y1' (and associated demarcation lines and arrows) should be applied as described in the specification, in the appropriate blank spaces on the incorrect published drawing, as is clearly shown on the accompanying (replacement) Sheet 2 of the drawings; and In the drawings, Sheet 2, Fig. 6, the dimension-indicating reference characters X2 & Y2 (and associated demarcation lines

UNITED STATES PATENT AND TRADEMARK OFFICE

CERTIFICATE OF CORRECTION

PATENT NO. : 4, 756,448

DATED : July 12, 1988

INVENTOR(S) : Frank L. Dahl

It is certified that error appears in the above-identified patent and that said Letters Patent is hereby corrected as shown below:

and arrows) should be applied, as described in the specification, in the appropriate blank spaces on the incorrect published drawing, as is clearly shown on the accompanying (replacement) Sheet 2 of the drawings; and In the drawings, Sheet 2, Fig. 7, the dimension-indicating reference characters X2' & Y2' (and associated demarcation lines and arrows) should be applied, as described in the specification, in the appropriate blank spaces on the incorrect published drawing, as is clearly shown on the accompanying (replacement) Sheet 2 of the drawings.

In the drawings, Sheet 3, Fig. 11, the present reference numeral 112 should be changed to 112b (meaning hole - - or slot-) so as to avoid being confused with the pin 112 shown in Fig. 4 (and with which it is adapted to be removably engaged); said correction being shown on the accompanying (replacement) Sheet 3 of the drawings.

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below: Title page:

In the Abstract, line 14, cancel "being" (second occurrence.)

In Column 1, line 30, cancel "arr" and insert --art--.

In Column 3, line 5, before "merchandise" insert --a--.

In Column 5, line 36, before "taken" insert --be--.

In Column 7, line 13, cancel "lyipg" and insert --lying--.

In Column 8, line 7, cancel "numberal" and insert --numeral--.

line 22, after "illustrated" insert a comma --,--.

line 53, after "mechanism" insert --and--.

In Column 9, line 42, cancel "lay" and insert --by--.

In Column 10, line 21, cancel "1" and insert --112--.

In Column 12, line 56, cancel "is" and insert --as--.

In Column 14, line 29, cancel "will raise" and insert --would require the unachievable raising of--.

line 42, cancel "a minimal" and insert --and appropriate--.

line 43, after "thickest" insert --(or the thinnest)--.

UNITED STATES PATENT AND TRADEMARK OFFICE

CERTIFICATE OF CORRECTION

PATENT NO. : 4,756,448

DATED : July 12, 1988

INVENTOR(S) : Frank L. Dahl

It is certified that error appears in the above-identified patent and that said Letters Patent is hereby corrected as shown below:

In Column 19, line 3, cancel "37" and insert --35--.

line 41, cancel "adpated" and insert --adapted--.

In Column 22, line 40, Claim 6, cancel "direction" (second occurrence) and insert --directed--.

In Column 23, line 1, Claim 6, cancel "fo" and insert --so--.

This certificate supersedes certificate of correction issued February 7, 1989.

Signed and Sealed this

Eleventh Day of July, 1989

*Attest:*

DONALD J. QUIGG

*Attesting Officer*

*Commissioner of Patents and Trademarks*